US010563823B2

(12) United States Patent
Chien

(10) Patent No.: US 10,563,823 B2
(45) Date of Patent: Feb. 18, 2020

(54) LED OR-AND LASER BULB

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 15/341,782

(22) Filed: Nov. 2, 2016

(65) Prior Publication Data

US 2017/0241596 A1 Aug. 24, 2017

Related U.S. Application Data

(60) Continuation-in-part of application No. 14/289,968, filed on May 29, 2014, now Pat. No. 9,551,477,
(Continued)

(51) Int. Cl.

| | |
|---|---|
| ***F21K 9/232*** | (2016.01) |
| ***F21S 8/00*** | (2006.01) |
| ***F21S 10/02*** | (2006.01) |
| ***F21V 5/04*** | (2006.01) |
| ***F21V 11/08*** | (2006.01) |
| ***F21V 14/02*** | (2006.01) |

(Continued)

(52) U.S. Cl.

CPC ..... *F21K 9/232* (2016.08); *F21K 9/65* (2016.08); *F21S 8/035* (2013.01); *F21S 10/02* (2013.01); *F21V 5/04* (2013.01); *F21V 11/08* (2013.01); *F21V 14/02* (2013.01); *F21V 14/06* (2013.01); *F21V 14/08* (2013.01); *F21V 23/0442* (2013.01); *F21K 9/238* (2016.08); *F21V 3/00* (2013.01); *F21W 2131/30* (2013.01); *F21Y 2113/10* (2016.08); *F21Y 2115/10* (2016.08)

(58) Field of Classification Search
None
See application file for complete search history.

(56) References Cited

U.S. PATENT DOCUMENTS 3,762,082 A 10/1973 Mincy
5,685,097 A * 11/1997 Marinov ..... G09F 19/08 362/283

(Continued)

*Primary Examiner* — Elmito Breval
(74) *Attorney, Agent, or Firm* — Bacon & Thomas, PLLC

(57) ABSTRACT

The current invention (1) has more than one bulb-base, or (2) has more than one optics-elements and at least one is optics-lens for 180 of degree flat or ½ ball, ⅔ ball, sphere, dome shape top cover of the said LED or-and Laser light-device or Bulb which has refractive or-and reflective or other optics properties to enlarge the image or lighted patterns to wider range or big area, or (3) has built-in or add-on flexible bendable arms or string-wire or conductive-wire to can change position, or direction or orientation of LED or-and Laser light beam by variety choices of moveable parts, or (4) can offer near-by and far-away illumination, image, lighted patterns, projection light, or any combination with all market available light effects or digital data display images, or (5) has more than one light beam emit out from LED or-and Laser light-device or bulb which under controller or IC or circuitry, or (6) has more than one functions to emit light beam which may be selected from power failure, remote control, Infra-red controller, blue-tooth, wifi Wi-Fi, internet, App software, motion sensor and wireless with multiple-way communication to trigger at least one of the light beam to offer illumination or-and project image or-and lighted patterns effects.

17 Claims, 17 Drawing Sheets

Related U.S. Application Data which is a division of application No. 14/280,865, filed on May 19, 2014, now Pat. No. 9,581,299, which is a division of application No. 13/540,728, filed on Jul. 3, 2012, now Pat. No. 8,834,009, which is a continuation-in-part of application No. 14/503,647, filed on Oct. 1, 2014, now Pat. No. 9,719,654, which is a continuation-in-part of application No. 14/606,242, filed on Jan. 27, 2015, now Pat. No. 9,541,260, which is a continuation-in-part of application No. 13/367,758, filed on Feb. 7, 2012, now Pat. No. 8,967,831, which is a continuation-in-part of application No. 14/983,993, filed on Dec. 30, 2015, now Pat. No. 9,909,739, and a continuation-in-part of application No. 15/170,071, filed on Jun. 1, 2016, which is a continuation-in-part of application No. 14/844,314, filed on Sep. 3, 2015, which is a continuation of application No. 12/938,564, filed on Nov. 3, 2010, now Pat. No. 9,239,513, which is a continuation-in-part of application No. 15/296,599, filed on Oct. 18, 2016, now Pat. No. 10,228,112, which is a continuation of application No. 14/503,647, filed on Oct. 1, 2014, now Pat. No. 9,719,654, which is a division of application No. 14/451,822, filed on Aug. 5, 2014, now Pat. No. 10,047,922, which is a continuation-in-part of application No. 14/323,318, filed on Jul. 3, 2014, now Pat. No. 10,222,015, said application No. 14/323,318 is a continuation-in-part of application No. 14/023,889, filed on Sep. 11, 2013, now Pat. No. 10,323,811.

(51) Int. Cl.

| | |
|---|---|
| ***F21V 14/06*** | (2006.01) |
| ***F21V 14/08*** | (2006.01) |
| ***F21V 23/04*** | (2006.01) |
| ***F21K 9/65*** | (2016.01) |
| *F21V 3/00* | (2015.01) |
| *F21W 131/30* | (2006.01) |
| *F21Y 115/10* | (2016.01) |
| *F21Y 113/10* | (2016.01) |
| *F21K 9/238* | (2016.01) |

(56) References Cited

U.S. PATENT DOCUMENTS

| | | | | |
|---|---|---|---|---|
| 5,934,223 | A * | 8/1999 | Ellery-Guy | A01K 15/025 119/702 |
| 6,162,100 | A * | 12/2000 | Al-Turki | F21V 19/006 439/641 |
| 6,267,478 | B1 | 7/2001 | Chen | |
| 6,350,042 | B1 * | 2/2002 | Lai | F21V 17/02 353/62 |
| 6,416,195 | B1 | 7/2002 | Lin | |
| 6,558,022 | B2 | 5/2003 | Kawahara | |
| 7,056,006 | B2 | 6/2006 | Smith | |
| 7,736,020 | B2 | 6/2010 | Baroky et al. | |
| 7,748,869 | B2 | 7/2010 | Sevack | |
| 7,789,532 | B2 | 9/2010 | Toriyama | |
| 7,871,192 | B2 | 1/2011 | Chien | |
| 8,113,698 | B2 | 2/2012 | Wu et al. | |
| 8,128,259 | B2 | 3/2012 | Myers | |
| 8,262,252 | B2 | 9/2012 | Bergman | |
| 8,721,160 | B2 | 5/2014 | Chien | |
| 8,827,496 | B2 | 9/2014 | Vanderschuit | |
| 8,834,009 | B2 | 9/2014 | Chien | |
| 8,847,491 | B2 | 9/2014 | Yotsumoto | |
| 9,081,269 | B2 | 7/2015 | Conti | |
| 9,107,248 | B2 | 8/2015 | Chen | |
| 9,134,012 | B2 | 9/2015 | Wu | |
| 9,206,952 | B2 | 12/2015 | Gold | |
| 9,217,555 | B2 | 12/2015 | Farmer | |
| 9,316,838 | B2 | 4/2016 | Chien | |
| 2001/0007527 | A1 * | 7/2001 | Lammers | F21S 6/002 362/294 |
| 2008/0304289 | A1 * | 12/2008 | Chien | H04N 5/2354 362/641 |
| 2010/0213880 | A1 * | 8/2010 | Chien | G09F 9/33 315/317 |
| 2010/0238672 | A1 | 9/2010 | Wu | |
| 2011/0085323 | A1 * | 4/2011 | Chien | F21S 9/02 362/183 |
| 2011/0116266 | A1 | 5/2011 | Kim | |
| 2011/0134239 | A1 | 6/2011 | Vadai | |
| 2014/0306599 | A1 | 10/2014 | Edwards | |

* cited by examiner

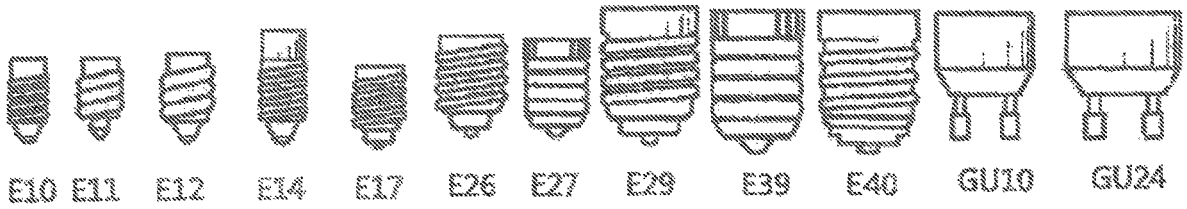
FIG. 1
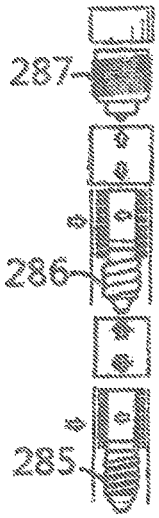
FIG. 2
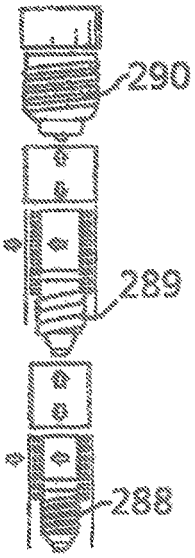
FIG. 3
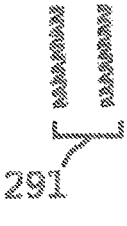
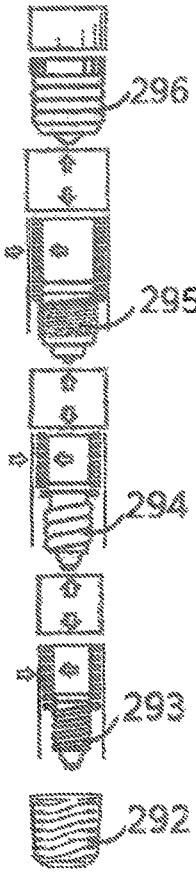
FIG. 4
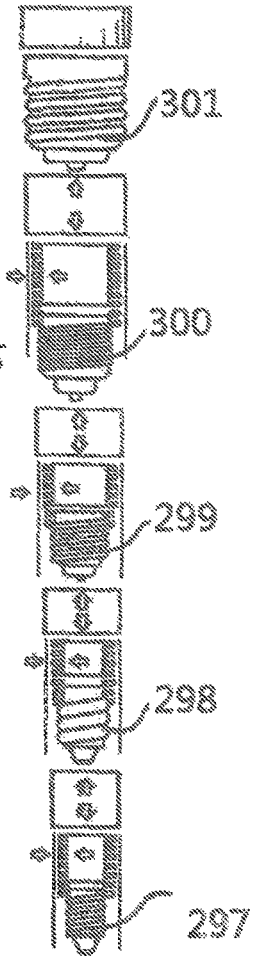
FIG. 5

(# FF-2008) Parent Case

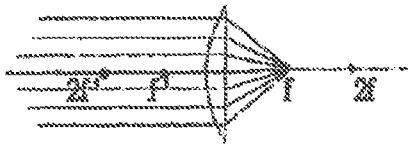

FIG. 26

Base Physic theory for Lens focus

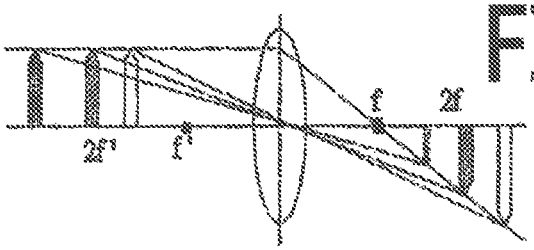

FIG. 27

Basci Physic theory
Relation of object v.s. image v.s. focus of lens.
1.object on 2f ' object has same size of image on 2f .
2.object between f ' and 2f ' ->
image behind 2f with large reverse image .
3. object away from 2f ' ->
the image will fall within 1f and 2f
with smaller and reverse image.

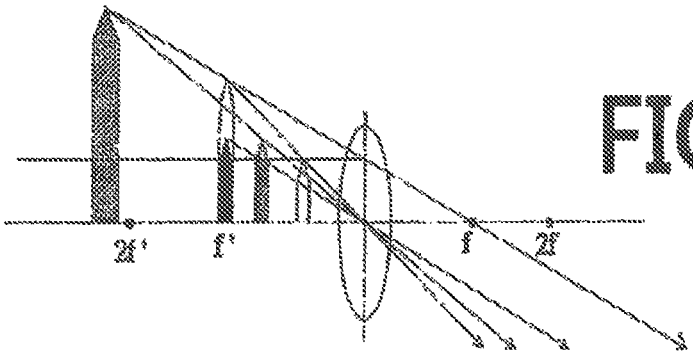

FIG. 28

Object location <f '=>
Image located on the same side of the f' . Image size
will become more smaller while the object more close
the lens.

Co-Pending (# ZZZ-4) Ser.No.15-296,599 P 1/12

Co-Pending (#QQQ-5) Ser.No. 15-341,782 P 9/15
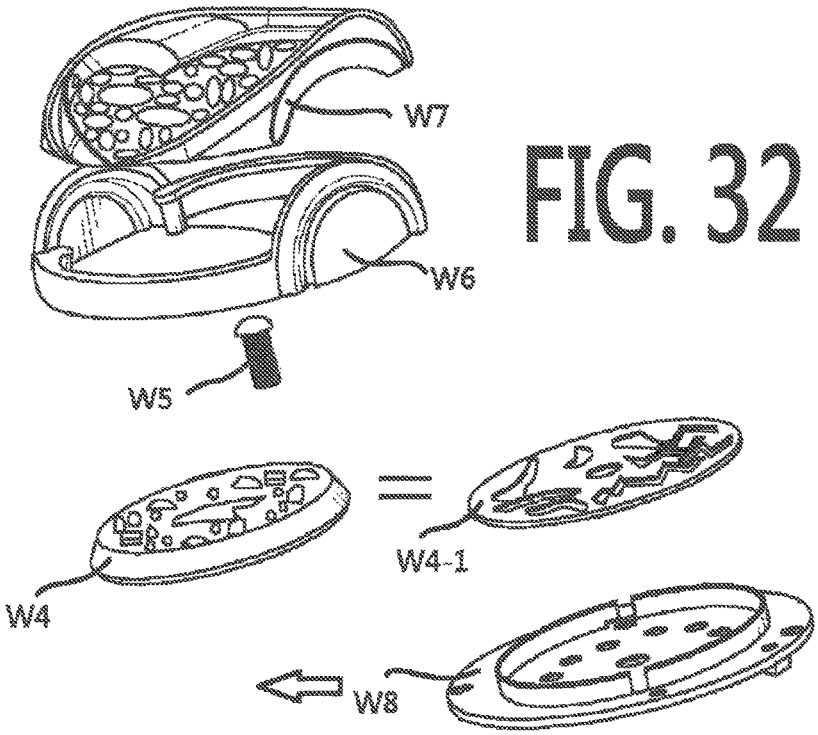
FIG. 32
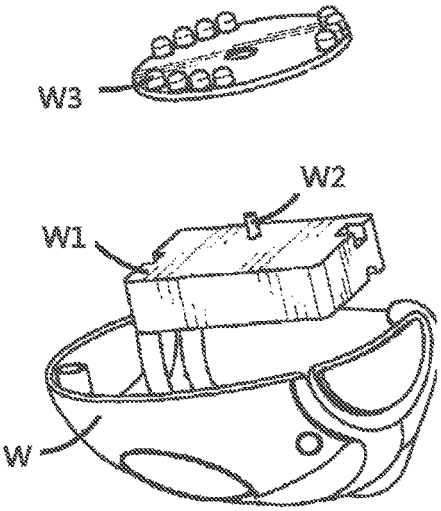
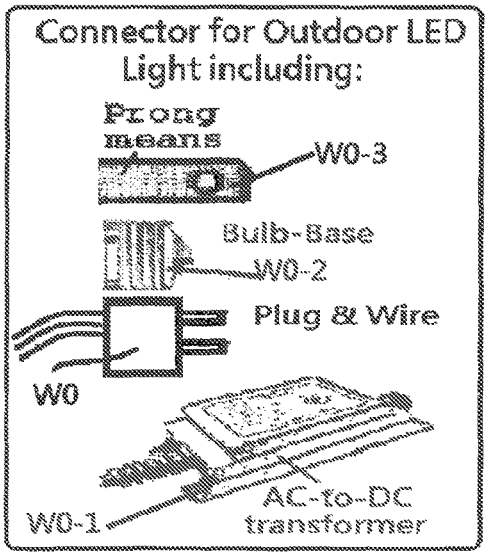

LED OR-AND LASER BULB

RELATED U.S. APPLICATION DATA

This filing is continuously fling for LED or-and Laser Bulb (# QQQ-3) U.S. application Ser. No. 14/983,993 filed on Dec. 30, 2015 which is the Continue filing for (#QQQ-2) U.S. application Ser. No. 14/289,968 filed on May 29, 2014 allowance on Oct. 5, 2016, which is Division filing of (# QQQ-1) of U.S. application Ser. No. 14/280,865, filed on May 19, 2014 and is Continuously of (#QQQ-12) U.S. Ser. No. 13/540,728 LED Bulb now is allowanced and issue fee paid before May 19, 2014 Now is U.S. Pat. No. 8,834,009. Related for LED bulb has project or-and night light.

This filing is Division filing of (#ZZZ-4) U.S. application Ser. No. 15/296,599 filed date on Oct. 18, 2016 LED or-and laser light device has more than one optics-element to create image or lighted patterns to the big range or wider areas U.S. application is PENDING filed on Oct. 15, 2016 which is continue filing of LED or-and Laser Bulb (#ZZZ-3) U.S. application Ser. No. 14/503,647 filed on Oct. 1, 2014 which is Division filing of (# ZZZ-2) U.S. application Ser. No. 14/451,822 filed on Aug. 5, 2014, which is Continue in Part filing of (# ZZZ-1) U.S. application Ser. No. 14/323,318 filed on Aug. 5, 2014 which is Continue in Pat filing of (# ZZZ-13) U.S. application Ser. No. 14/023,889 filed on Sep. 11, 2013. Related to apply the reflective or refractive optics lens or optics elements to create the wider area image or lighted patterns for LED or-and Laser light device powered by conductive parts including prong, USB-wires or for LED or-and Laser Bulb base for with or without motor/spin/rotating kits for moving image.

The current invention is division filing The current invention is continuously filing (#XX-2) U.S. application Ser. No. 15/170,071 filed on Jun. 1, 2016 which is continuously filing of (# XX-1) U.S. Application Ser. No. 14/844,314 filed on Sep. 2, 2015 which is continue of (#XX-2010) U.S. application Ser. No. 12/938,564 filed on Nov. 3, 2010 and now is U.S. Pat. No. 9,239,513

This filing is Division filing of (# MMM-1) U.S. application Ser. No. 14/606,242 filed on Jan. 27, 2015 now is allowed on Sep. 25, 2016 which is Continue in Part of (# MMM-11) U.S. application Ser. No. 13/367,758 filed on Feb. 7, 2012, Now is U.S. Pat. No. 8,967,831 related for the LED Bulb has extendable/retractable design to overcome block-items that may interfere the camera, electric signal delivery.

This filing is Division filing of (# JJJ-1) U.S. application Ser. No. 14/049,427 now is U.S. Pat. No. 9,010,986 Apr. 21, 2015 issued, which is continue filing of (#JJJ-11) U.S. application Ser. No. 13/296,508 Filed on Nov. 15, 2011. Now is U.S. Pat. No. 8,562,158 issued on Oct. 22, 2013. Related the LED bulb has built-in Camera and storage-kits with multiple functions to replay, see by wired or wireless.

BACKGROUND

This filing is continuously fling for LED or-and Laser Bulb (# QQQ-3) US publication Ser. No. 14/983,993 filed on Dec. 30, 2015 which is the Continue filing for (# QQQ-2) US application Ser. No. 14/289,968 filed on May 29, 2014 now is allowed on Oct. 5, 2017, which is Division filing of (# QQQ-1) of U.S. application Ser. No. 14/280,865, is allowanced and issue fee paid before May 19, 2014 Now is U.S. Pat. No. 8,834,009. Related or LED or-and Laser Bulb has project or-and night light.

This filing is Division filing of (#ZZZ-4) U.S. application Ser. No. 15/296,599 filed date on Oct. 18, 2016 LED or-and laser light device has more than one optics-element to create image or lighted patterns to the big range or wider areas U.S. application is PENDING filed on Oct. 15, 2016 which is continue filing of LED or-and Laser light device (# ZZZ-3) U.S. application Ser. No. 14/503,647 filed on Oct. 1, 2014 which is Division filing of (# ZZZ-2) U.S. application Ser. No. 14/451,822 filed on Aug. 5, 2014, which is Continue in Part filing of (# ZZZ-1) U.S. application Ser. No. 14/323,318 filed on Aug. 5, 2014 which is Continue in Pat filing of (# ZZZ-13) U.S. application Ser. No. 14/023,889 filed on Sep. 11, 2013. Related to apply the reflective or refractive optics lens or optics element to create the wider area image or lighted patterns for LED or-and Laser light device powered by conductive parts including prong, USB-wires or for LED or-and Laser light device Bulb base for with or without The current invention is division filing The current invention is continuously filing (#XX-2) U.S. application Ser. No. 15/170,071 filed on Jun. 1 2016 which is continuously filing of (# XX-1) U.S. Application Ser. No. 14/844,314 filed on Sep. 2, 2015 which is continue of (#XX-2010) U.S. application Ser. No. 12/938,564 filed on Nov. 3, 2010 and now is U.S. Pat. No. 9,239,513

This filing is Division filing of (# MMM-1) U.S. application Ser. No. 14/606,242 filed on Jan. 27, 2015 now is allowed on Sep. 25, 2016 which is Continue in Part of (# MMM-11) U.S. application Ser. No. 13/367,758 filed on Feb. 7, 2012, Now is U.S. Pat. No. 8,967,831 related for the LED Bulb has extendable/retractable design to overcome block-items that may interfering the camera, electric signal delivery.

This filing is Division filing of (# JJJ-1) U.S. application Ser. No. 14/049,427 now is U.S. Pat. No. 9,010,986 4-21, 2015 issued, which is continue filing of (#JJJ-11) U.S. application Ser. No. 13/296,508 Filed on Nov. 15, 2011. Now is U.S. Pat. No. 8,562,158 issued on Oct. 22, 2013. Related the LED light device has built-in Camera and storage-kits with multiple functions to replay, see by wired or wireless.

The current invention is Continuously or Division filing for co-pending filing case as below which NOT ONLY for parent filing for LED or-and Laser light device features but also including (1) Project light (2) More than one function (3) adjust focus (4) adjust angle elastic contact points or conductive spring (6) LED heat solution (7) Heat sensitive parts isolation or ventilation (8) extend or movable parts. ALSO including new features including below list:

Features (1) the current invention for LED or-and Laser Bulb main purpose to has built-ins more than one of the bulb-base(s) for desired combinations for market available bulb base(s) into one LED or-and Laser bulb so the one LED or-and Laser bulb male base can fit into more than one of different size of female Bulb-socket. This will reduce the LED or-and Laser bulb products at factory or at the shelves of market. The current market existing all kind of bulb has only one size or one specification of bulb-base to fit into only one bulb socket. For Examples, the LED or-and Laser bulb has E26 bulb-base which only can fit into E-26 bulb socket is for current market all LED or-and Laser bulb specification. The Current invention LED or-and Laser Bulb may have E26 (bigger) and E-17 (medium) or further has E12 (Small) diameter of the Bulb-base so can fit into at least 3 different LED or-and Laser Bulb-Socket receiving end including E26+E17+E12 . . . or other desired combination E26+E12 or E-26+E17 or E26+E17+E12 . . . . The said LED or-and Laser bulb market available bulb base has different construction including but not limited for (1) Screw Bases (2) Twist & Lock Bases (3) Specialty Bases (4) Bi-Pin Bases, and current invention not discuss the (5) Fluorescent Pin Base Compact Fluorescent plug in Lamp Base.

For examples, the current invention discussed the most common LED or-and Laser bulb base is the screw bases has different diameter from E10 (mini screw), E11 (mini candelabra), E12 (candelabra), E14 (European), E17 (intermediate), E26 (Medium-standard), E27 (Medium), E39 (Mogul), E40 (Mogul), EX39 (Extended Mogul).

Feature (2) has more than one optics-elements and at least one is optics-lens for 180 degrees flat or ½ ball, ⅔ ball, sphere, dome shape top cover of the said LED or-and Laser Bulb which has refractive optics properties to enlarge the image or lighted patterns to wider range or big area to viewer. The said LED or-and Laser bulb has the top cover is wider opening may in the form of around 180 of degree flat optics-lens, or ½ ball, ⅔ ball, sphere, or dome shapes with refractive optic-lens properties so can let inner LED or-and Laser light source very narrow viewing angle Light beam to spread out through the Top Cover Optics-lens.

Also, the co-pending filing (#ZZZ-4) U.S. application Ser. No. 15/296,599 filed date on 10-18, 2016 LED or-and laser light device has more than one optics-element to create image or lighted patterns to the big range or wider areas U.S. application is PENDING filed on Oct. 15, 2016 which is continue filing of LED or-and Laser Bulb (# ZZZ-3) U.S. application Ser. No. 14/503,647 filed on Oct. 1, 2014 both has details construction and preferred design and also has the co-pending drawing for same optics application on FIG. 1A, FIG. 1B, FIG. 1C, FIG. 1BB, FIG. 1CC for all details and features for more than one optics-elements can create more special and complicated lighted patterns or-and image.

Features (3) has built-in or add-on flexible bendable arms to can change position, or direction or orientation of LED or-and Laser light beam by variety choice of moveable parts as the current invention FIG. 3D show the add-on snake hose which one end is bulb-socket and the other end is bulb-base to insert into existing bulb-socket. From FIG. 3E show the LED or-and laser bulb is a built-in model which the snake house one end is part of Bulb and other end has the mail bulb-base which can adjust the said Bulb to any direction or-and orientation or-and height to overcome all block-object including glass shade, depth location of bulb-socket of market all recess lighting, block-object also will interfere the electric signal such as Wi-Fi or remote control (IR) or wireless controller. From FIG. 3F for preferred the LED bulb has more than one levels and top level has $1^{st}$ function and lower level has $2^{nd}$ functions as just allowed (# QQQ-2) US application Ser. No. 14/289,968 filed on May 29, 2014 now is allowed on Oct. 5, 2017 for 19 claims. It is appreciated all above listed or discussed co-inventor co-pending or co-issued patent all the idea, concept, claims, specification, features, functions still fall within the current invention scope of claims for replaceable, equivalent, equal functions reason.

Feature (4) can offer near-by and far-away illumination, image, lighted patterns, or any combination with all market available light effects or digital data display images. The current invention for LED or-and Laser bulb as Child filing of the Co-inventor parent filing including the parent co-pending or issued patents as LED or-and Laser Bulb (# QQQ-3) U.S. application Ser. No. 14/983,993 filed on Dec. 30, 2015 which is the Continue filing for (# QQQ-2) US application Ser. No. 14/289,968 filed on May 29, 2014 now is allowed on Oct. 5, 2017, which is Division filing of (# QQQ-1) of U.S. application Ser. No. 14/280,865, filed on May 19, 2014 and is Continue of (# QQQ-12) U.S. Ser. No. 13/540,728 LED Bulb now is allowanced and issue fee paid before May 19, 2014 Now is U.S. Pat. No. 8,834,009. Related for LED or-and Laser Bulb has project or-and night light.

For the LED or-and Laser Light device including Bulb which has more than one optics-elements and at least one is optic-lens which may in the form of (1) around 180 big opening for Flat optic-lens which has multiple or plurality of optics lens with different thickness and size to form a flat around 180 of degree flat lens and with different height which has refractive properties so can let all inner LED or-and laser light beam to spread out to wider areas or big size on desired surface. It will incorporate with (AA) multiple or plurality of reflective tiny piece on the main disc or dish like inner surface to spread more light beam, (BB) No. 3 or more optics-element including nuts or core or solid geometric shape unit and surface has a lot of optics-design small piece so can spread narrow light beam to many light beam, (CC) motor or movement device to make the one light beam become moving light beam and for thousands of thousand light beam will make splendid moving, colorful, color changing or other market light effects such as Moving Water wave, moving Aurora effects all be some samples but not limited such as the Disco ball has multiple lighted patterns shown surface also use more than one reflective or-and refractive tiny lens in one main top cover so need 2 pcs separated 2 piece optics-lens.

Feature (5) has more than one light beam emit out from LED or-and Laser bulb which under controller or IC or circuitry. To incorporate with IC and more than one color LEDs or plurality of different color LED or-and laser light source under IC and circuit arrangements can get the more than one light beam emit out from the said LED or-and Laser bulb. The more than one light beam emit out from LED or-and laser bulb is same as Co-pending or co-issued filing case and current invention FIG. 3F which has 2 level or more for Bulb and top has at least one function for project image or lighted pattern or illumination functions. The lower portion also can offer color changing light beam or multiple different kelvin temperature for white light. Please refer to Co-pending or issued (# QQQ-2) and (# QQQ-1) so can get most detail construction, details from U.S. application Ser. No. 14/983,993 filed on Dec. 30, 2015 which is the Continue filing for (# QQQ-2) U.S. application Ser. No. 14/289,968 filed on May 29, 2014 now is allowed on Oct. 5, 2017, which is Division filing of (# QQQ-1) of U.S. application Ser. No. 14/280,865, filed on May 19, 2014 and is Continue of (# QQQ-12) U.S. Ser. No. 13/540,728 LED Bulb now is allowanced and issue fee paid before May 19, 2014 Now is U.S. Pat. No. 8,834,009. Related for LED or-and Laser Bulb has project or-and night light.

Feature (6) has more than one function to emit light beam and also can has more functions which may selected from power failure, remote control, Infra-red controller, bluetooth, Wi-Fi, internet, App software, motion sensor and wireless with multiple-way communication to trigger at least one of the light beam to offer illumination or-and image or-and lighted patterns effects.

Features (7) as co-pending filing case has movable-parts to allow the at least one of level of the more than one lever LED or-and Laser bulb can move the desire level(s) away from original position, location, orientation to overcome all the interfere block-objects so the said LED or-and Laser bulb can solve the (a) heat issue from LED(s) or-and Laser or circuit or electric components (b) lamp shade metal frame's block out the LED or-and Laser bulb light beam traveling (c) glass or metal or cement block to block out the electric signals transmit or wireless electric signals delivery including but not limited including Bluetooth, Wi-Fi, internet, App software or any other electric wave or signals transmitting to control the said LED or-and Laser bulb and its related electric parts or accessories.

Hereafter disclosure all below listed co-pending and patented as prior arts still fall within the current invention as below: U.S. Ser. No. 13/367,758, U.S. Ser. No. 13/367,687, U.S. Ser. No. 13/296,508, U.S. Ser. No. 13/295,301, U.S. Ser. No. 13/021,107, U.S. Ser. No. 12/950,017, U.S. Ser. No. 12/938,564, U.S. Ser. No. 12/886,832, U.S. Ser. No. 12/876,507, U.S. Ser. No. 12/771,003, U.S. Ser. No. 13/021,124, U.S. Ser. No. 12/624,621, U.S. Ser. No. 12/622,000, U.S. Ser. No. 12/318,470, U.S. Ser. No. 12/914,584, U.S. Ser. No. 12/834,435, U.S. Ser. No. 12/292,153. U.S. Ser. No. 12/907,443, U.S. Ser. No. 12/232,505, U.S. Ser. No. 11/806,711, U.S. Ser. No. 11/806,285.

The current invention is Continue filing for Ser. No. 13/295,301 "The Device has built-in Digital Data and Powered by unlimited power source of light device".

The current invention is Continue filing for Ser. No. 13/296,508 "The Device has built-in Digital Data and power unlimited power source of LED Bulb"

The current invention is continuously filing for Ser. No. 13/296,460 "The device has built-in Digital data and powered by unlimited power source of Lamp Holder.

These (3) co-pending filing are Continuously filing of Ser. No. 12/951,501 "Lamp Holder has built-in LED Night light"

The current invention is continuously filing for Ser. No. 12/950,017 "Multiple surface LED light"

All these are Continuously filing for Ser. Nos. 13/296,508, 13/295,301, 13/296,469 are continuously filing for Ser. No. 13/162,824 Light device with display has track-means and removable LED-unit(s) which are the continuously filing for Ser. No. 12/938,628 LED light fixture has outlet(s) and removable LED unit(s) and for Ser. No. 12/887,700 Light fixture with self-power removable LED unit(s). Those are continuously filing for Ser. No. 12/149,963 (Now patented U.S. Pat. No. 7,722,230), Ser. No. 12/073,095 (Now patented U.S. Pat. No. 7,726,869), Ser. No. 12/073,889 (Co-Pending Filing), Ser. No. 12/007,076 (Now patented U.S. Pat. No. 7,726,841), Ser. No. 12/003,691 (Now Patented U.S. Pat. No. 7,726,839), Ser. No. 12/894,865 (Co-Pending Filing).

The current invention incorporated with above listed co-pending or patented cases' features, construction still fall within the current inventions scope and all related equivalent function or replace parts also should fall within the current invention.

From other co-pending LED or-and Laser light device (#ZZZ-4) U.S. application Ser. No. 15/296,599 filed date on Oct. 18, 2016 LED or-and laser light device which is continuously filing of (# ZZZ-3) U.S. application Ser. No. 14/503,647 filed on Oct. 1, 2014 and co-pending filing case for LED or-and Laser Bulb (# QQQ-3) U.S. application Ser. No. 14/983,993 filed on Dec. 30, 2015, both show the drawing and brief drawing and details description show the LED or-and laser light device on the Figure which the one LED device can has LED light source or-and Laser light source within the housing with at least one of the optics elements (non-optics lens) or-and optics lens to make the desired (1) reflection or refraction by optics lens(es), or (2) shaped the light beam by stencil/opening/window/printed film, or (3) presentation of the full color images, moving image, color changing light by slide/film/photos/LCD displayer/image forming kits/internet/APP/Wi-Fi/Wireless network/Wireless incorporated with image medium or interface kits. So the current invention continuously to develop improvements to make the co-pending filing and current filing of LED or-and Laser Bulb has more universal features to created desired functions as below:

The current invention is continuously filing (#XX-2) U.S. application Ser. No. 15/170,071 filed on Jun. 1, 2016 which is continuously filing of (# XX-1) U.S. application Ser. No. 14/844,314 filed on Sep. 2, 2015 which is continue of (#XX-2010) U.S. application Ser. No. 12/938,564 filed on Nov. 3, 2010 and now is U.S. Pat. No. 9,239,513

The current invention has a big improvement from marketing all LED or-and Laser Bulb to make them a Universal type to fit into more than one kind of bulb-socket female receiving end. From above discussed Features (A) the current invention's main purpose to has built-in more than one of the bulb-base(s) for desired combinations for market available bulb base(s) into one LED or-and Laser bulb so the one LED or-and Laser bulb can fit into more than one of different size of bulb-socket. This will reduce the LED or-and Laser bulb which only has one size or one specification of bulb-base to fit into only one bulb socket. For Examples, the LED or-and Laser bulb has E26 bulb-base which only can fit into E-26 bulb socket is for current market all LED bulb specification. The Current invention LED or-and Laser Bulb may have E26 (bigger) and E-17 (medium) or further has E12 (Small) diameter of the Bulb-base so can fit into at least 3 different LED or-and Laser Bulb-Socket receiving end including E26+E17+E12 . . . or other desired combination E26+E12 or E-26+E17 or E26+E17+E12 . . . . The said LED or-and Laser bulb market available bulb base has different construction including but not limited for (1) Screw Bases (2) Twist & Lock Bases (3) Specialty Bases (4) Bi-Pin bases, and current invention do not discuss the (5) Fluorescent Pin Base (6) Compact Fluorescent plug in lamp Base. For examples, the current invention discussed the most common LED or-and Laser bulb base is the screw bases has different diameter from E10 (mini screw), E11 (minicandelabra), E12 (candelabra), E14 (European), E17 (intermediate), E26 (Medium-standard), E27 (Medium), E39 (Mogul), E40 (Mogul), EX39 (Extended Module).

The current invention not only had the above listed feature (A) but also has co-pending filing case for LED or-and Laser bulb has at least one level and its movable design can make the (1) at least one level of the said LED or-and Laser Bulb to move or-and (2) whole LED or-and Laser bulb to adjust by the build-in or add-on snake house which has at least one or both of the bulb base male base & female socket so can use flexible bendable arms to change the position, location, orientation away from original position while need to make desire locations has the predetermined light functions, performance, effect.

The at least one of the level (or parts or accessories) incorporate with movable-design so can move the at least one of level (including parts or accessories) or-and move the whole LED or-and Laser bulb by the build-in or add-on bendable flexible snake-house away from original position, location, orientation so can overcome some block-object(s) which affect or interfere the LED or-and Laser bulb desire functions.

Such as the current invention's more than one level(s) LED or-and Laser bulb, the top part is a project light functions but while it installed on all desk lamp, floor lamp, down light, indoor lighting or outdoor lighting, the current invention will have lamp shade problem because some of lamp shade has metal frame and ring on the center line of the LED or-and Laser bulb's and lamp socket. So if the LED or-and Laser bulb has no movable design to move the level(s) or-and flexible snake-house, the top part project light's image or lighted patterns will be block out by the lamp shade's metal frame and metal rings to destroy the project image or any lighted patterns performance. The current invention solved this issue and let the top part of the LED or-and Laser project light or-and lighted patterns can move away from the said Lamp shade's metal frame and metal ring so can let the LED or-and Laser project beam pass though no block-objects area and create the image/message/time/lighted patterns/digital data/digital image/LCD display image/arts on the desired ceiling or-and walls or-and floor surface. If use traditional LED or- and Laser Bulb, the lamp shade block-objects will totally destroy the LED or-and Laser project light performance including not limited full color image or color changing lighted patterns or light beam.

The current invention also can solve the heat issues of all market available LED or-an Laser Bulb. The simple solution is let the LED(s) or-and Laser and electric parts, accessories, components all located on the base part of the said more than one level(s) LED or-and Laser bulb or at least one level of the LED or-and Laser bulb to has the movable design which including all kind of moving parts which may including spin, rotate, hinge, arms, joint piece, join pieces, extendable, extractable, flexible bendable snake house has at least one of male bulb-base or both male bulb-base & female bulb receiving socket, or the other market available adjustable kits, parts, set to make the heat source away from the other part.

One of preferred embodiment the said more than one level(s) LED or-and Laser Bulb, (1) Same as parent filing all electric parts may put on Top part so all heat will move to top areas OR (2) Same as current invention some preferred embodiment drawings to show all the electric parts put on the base part and move the top parts away from heat upper area so the heat will not affect to the other parts. The both solution has use the movable-design from extractable, extend, movable parts or accessories, rotate, pole, hinge, arm, bar, snake-house or whatever the movable or adjustable design can move the parts or-and whole LED or-and Laser Bulb to other location so can easily to overcome the heat issues.

The current invention LED or-and Laser bulb also good for LED or-and Laser Bulb for upper or down installation because has the movable-design including extractable, extendable which can overcome the down light application because some down light (LED or-and Laser Bulb base face sky) has lamp shade (like entrance door lighting) which made of glass, metal, cement, concrete surrounding the said Down light or recess light installation so these electric-signal block-objects will affect, interfere the electric signal transmitting so let Bluetooth control, Wi-Fi, remote control, infra-red control, internet control, App software control loose or reduce or limited the signal transmitting to let these functions become a problem. So the current invention has all proper movable-design help to overcome these electric signal block objects and make the LED or-and Laser bulb has its designed and pre-determined functions without any affect or interfere or limited by the said electric-signal block-means.

The current invention has more than one level(s) (including parts and accessories) LED or-and Laser bulb which each level can has its own functions or multiple functions control by market available skill or method may selected from Blue-tooth, Wi-Fi, internet, App software, IC, Remote signal, infra-red signal, motion sensor, heat sensor though computer, communication, consumer device by people. Such as the more than one levels LED or-and Laser Bulb has (1) Multiple colors with changeable colors and moving effects (2) Multiple functions select from market available any LED or-and Laser light effects for indoor and outdoor lighting (3) Multiple control which select from market available control, sensor, switch, blue-tooth, Wi-Fi, internet, app software, remote, infra-red or other electric or electronic related circuit or device(s) (4) More than one movable designs (5) Changeable geometric shape (6) Changeable construction (7) moveable designs select from any group combination from bar, pole, spin, rotate, hinge, arms, joints, join, frame, connector, sections or-and move the whole LED or-and Laser bulb by the build-in or add-on bendable flexible snake-house to make the levels, whole LED or-and Laser Bulb, parts, accessories to be move away to desire location, positions. These are the $2^{nd}$ of main features of the current invention.

The current invention mainly for LED or-and Laser bulb which has following (10) other features as parent filing case stated as below:

1. The current invention which the said LED or-and Laser Bulb has property that the LED or-and Laser bulb can have more twist degree or twist angle after LED or-and Laser Bulb's Contact-Point touched electrodes, this features can get horizon more than 360 of degree to let the light beam to position the certain area(s) to get more wider of adjust angle and more wider of adjust directions and it also can incorporate with adjustable focus to make the same of LED or-and Laser light beams or image to shown different light performance on the desired locations or area(s). The Rotatable LED or-and Laser Ball with two arms to offer the said LED or-and Laser Bulb of preferable Geometric shape and construction, can adjust angle in vertical axis up to more than 360 of degree angle so can get the LED or-and Laser Bulb's plurality of light beams can cover all x-y-z axis areas by at least one of light beam or plurality of the light beam to illuminate the near-by or far-away or remote-away or any combination of the said LED or-and Laser Bulb. (Lamp holder co-pending).

2. The current invention which the said LED or-and Laser Bulb has One or more than one of the light beams arrange in LED or-and Laser bulb for desire light performance. As co-pending filing content which has more than one LED or-and Laser light source(s) are for Night light, more than on project assembly for project LED or-and Laser lighting. The current invention can create same light performance as the co-pending or patented applications as attached drawings for LED or-and Laser bulb just change the power source input current from 2 prongs to the bulb-base 2 pole so can simple to get same functions or equivalent or replaceable from prong to bulb-base, the difference than prior-arts with night light because Night light has prongs and for outlets installation and not have extend/retractable kits. The said LED or-and Laser bulb has bulb-base to get the power from outside power source.

3. The current invention which the said LED or-and Laser Bulb Have Focus adjustable kits so can make same light beam to emit out from same LED or-and Laser bulb to wherever surface(s) with desired light performance of brightness, size, light spots, color, lit-areas. The same light beam output from same LED or-and Laser Bulb with focus adjustable kits can create the different light pattern, light path, light brightness or color, light performance, light direction, light performance by viewer.

4. The current invention which the said LED or-and Laser Bulb has extendable kits such as extension tube, telescope tube extended housing parts or move the multiple layers of bulb or equivalent extendable, receivable kits which can make the electric parts & accessories etc. of LED or-and Laser bulb keep away from LED(s) or-and Laser 's heat, block-means of lighting's curtain, lighting's shade, lighting's glass, cylinder tube of detector, remote control signal, or light beam emit direction. To keep the said LED or- and Laser bulb's related cir recess lighting, or other block-objects which block the motion-sensor Fresnel lens & LED and Laser-units or block-objects to prevent from heat affect the desire functions, performance, such as Motion sensor or PIR sensor head or Fresnel lens or LED or-and Laser-unit light beam emit direction.

5. The current invention which the said LED or-and Laser Bulb has Extractable/extendable/movable kits to put heat sensitive or light sensitive parts or housing parts away from LED or-and Laser s' heat, light's shade, light's curtain, light's glass, decorative material, ceiling block, or any other block-objects which will interfere the LED or-and Laser bulb or LED or-and Laser Bulb's related parts & accessories. The said extendable or extractable kits preferred to design on front of the LED or-and Laser bulb, but it depend on the different requirement and different consideration of heat, block—objects which offer the more space to install the preferred electric parts & accessories, offer the extra length to far-away from heat or block-objects so the LED or-and Laser bulb can overcome heat and block—objects for any applications, installation.

6. The current invention is different from all market available LED or-and Laser Bulb which offer The illumination only cover the adjacent area which are start from the LED or-and Laser Bulb to certain distance (illumination surrounding LED or-and Laser Bulb or start from LED or-and Laser bulb to certain distance with illumination) and do not offer the desired areas or wider viewing angle or cover big areas away from the LED or- and Laser bulb illumination or-and image or-and lighted patterns to an area(s) which has certain direction(s), angle(s), distance(s) which far away or remote-away from the LED or-and Laser Bulb. The current invention can make any combination to offer the near-by areas illumination, far-away areas illumination or together for both illumination or-and image or-and lighted patterns effects. The market Laser Bulb only can offer the said laser beam from laser light source but it too harmful for people eyes, so the co-pending filing is continuously filing (#XX-2) U.S. application Ser. No. 15/170,071 filed on Jun. 1, 2016 which is continuously filing of (# XX-1) U.S. application Ser. No. 14/844,314 filed on Sep. 2, 2015 which is continue of (#XX-2010) U.S. application Ser. No. 12/938,564 filed on Nov. 3, 2010 and now is U.S. Pat. No. 9,239,513 which has the motion sensor protection device to shut-down the Laser light beams while people come close to the safety distance, Also, the laser light incorporated the grating film, piece, sheet to make the strong Laser beam been split into multiple light beams so become harmless to people eyes. For some cost concern, the bulb for some applications can save the motion sensor safety device.

7. The current invention which the said LED or-and Laser Bulb has more than one light beams output to different area(s), direction(s), location(s) and make more than one years with illuminations which all these areas may not adjacent, link, sit together. The said LED or-and Laser bulb may offer more than one area(s) have illumination is other features of current other features which can allow people to make the energy saving and only offer illumination for where needed such as Stair lighting which only Up or Down two direction need illumination to see stairs. (Please refer to co-inventor's U.S. application Ser. No. 12/771,003, Filed on Apr. 30, 2010, Now is U.S. Pat. No. 8,408,736 Apr. 2, 2013 issued) Rest areas no need the light at all and the said stair-lighting has built-in Motion Sensor has sensitivity up to 10-30 feet is enough to cover one floor stairs (Normally is 18 steps). One light beam for LED or-and Laser bulb to emit up 9 steps and one light beam of same LED or-and Laser bulb to emit down 9 steps. This will be enough illumination because each UP or DOWN stair being illuminated by each Floor's one LED or-and Laser Bulb, so 2 different of light beam(s) to offer same one UP or One Down 9 steps. This is pretty good power saving device while motion sensor device build-in more than one of light beam as output from one LED or-and Laser bulb.

8. The current invention also teaches the co-pending filing (#ZZZ-4) U.S. application Ser. No. 15/296,599 filed date on Oct. 18, 2016 LED or-and laser light device and the said device including for bulb, or plug-in night light, or USB LED or-and laser light. These applications all use the same more than on of optics-elements and the top cover is a half-ball, ⅔ ball, sphere, dome or approximately 180 degree flat optics-lens which has at least one of refractive lens properties. All these application only need to connect the (+) (−) input current to connect to bulb-base or plug-in night light or USB light's relative electric poles with preferred working voltage so can have same construction for the optics-elements and LED or-and laser light source change from Bulb to Plug-in or USB light, or change from Plug-in light to the bulb or USB light, or change from USB light to Bulb or plug-in light as (#ZZZ-4) U.S. application Ser. No. 15/296,599 filed date on Oct. 18, 2016 details drawing and descriptions.

9. The current invention also teaches the co-pending and (JJ-3) and (# JJJ-1) Application Ser. No. 14/049,427 now is U.S. Pat. No. 9,010,986 4-21, 2015 issued, which is continue filing of (#JJJ-11) U.S. application Ser. No. 13/296,508 Filed on Nov. 15, 2011. Now is U.S. Pat. No. 8,562,158 issued on Oct. 22, 2013. Related the LED bulb has built-in Camera and storage-kits with multiple functions to replay, see by wired or wireless.

Hence, the current invention can have at least one or plurality of light beam output from one LED or-and Laser bulb to near-by area(s), remote-away area(s), far-away area(s) or any combination of these area(s) with adjust angle, adjust focus, elastic contact-point, rotate/spin/tilt frame or support or base to get desire direction to emit light beam, extend/retractable to install all parts & accessories away from heat or block-are all belong to current invention features so can let all light beam to emit to area(s) where need the illumination, not like conventional LED or-and Laser bulb only can supply the near-by area(s) which start from the LED or-and Laser-bulb to certain limited distance areas (LED or-and Laser bulb has limited brightness to emit to long distance except like current invention to apply optics lens or lens assembly to project light beams to remote-away or far-away distance which current market items cannot create.)

DRAWINGS

FIG. 01 shows the current commonly screw bases which used for bulb bases worldwide.

FIG. 02-1, 02-2, 02-3, 02-4, 02-5, 02-6 shows the exemplary of six different bulb bases connected to each of the multiple bulb bases (hereafter as combo bases) that are not of the same combination and each of the bulb base's size as the exemplary using this specific design of current invention. The figures show the details of measurements of each of these individual bulb bases and the gap existing while overlap each bigger one to small one, however, the measurements are not limited to this documents but the compatibility of the said combo-bases. The combo-bases are not limited to the combination shown in drawing this document but also the compatibility of the said adapter invention.

FIG. 03, 04, 05 shows a way of conducting electricity throughout the said combo-bases. The usage of proper diameter conductive or elastic springs fit within the gap between the bigger and small diameter bases to deliver the current from lower position small base to all top bigger bases so the said combo-bases will carry electricity from the lower position's N-pole (the said of the "end" of a bulb base") towards to the top location other base's N-pole. These springs, connecting between the whole combination, on all wall of each said bulb bases N-pole wall, will act as a conduit for electricity to pass while being able to be an assistant for the said stretch and shrink ability. The L-pole delivers current by center electric isolation channel with electric conductive springs fit within from the said biggest size, bulb base to the smallest size, bulb base. Noted that the combination of FIG. 03 and FIG. 04 and FIG. 05 shown in these three figures will not limit the future said combo-bases to the number of total bulb bases, these figures are only for demonstration purposes of this said combo-bases.

Figure 9:
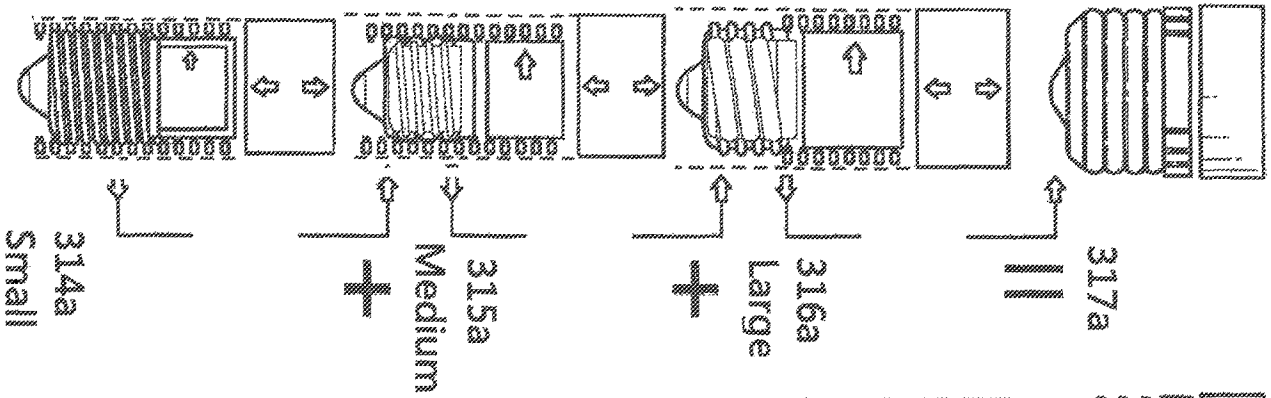
FIG. 09A shows the said combo-bases to have one spring in the middle of electric isolated tube to provide the ability to stretch/extend and shrink/retract and the power to connect electricity throughout the each of bulb bases along the whole combo-bases.

FIG. 09 shows the idea of the said combo-bases to be able to screw in more than one of the female receiving bulb socket while shrank/retract with two, exemplary, The Big bulb bases (Male E26) can fit into inside one big bulb-socket (Female E26) one; or one Medium bulb base (Male E17) can fit into inside one medium bulb-socket (Female E17) while combo-bases stretched half-way. This figure also shows the fully stretched exemplary combo-bases has the smallest base (Male E12) which can fit in the smallest size of bulb-socket (Female E12). From this FIG. 09 also show the reverse example.

FIG. 09-B1, FIG. 09-B2, FIG. 09-B3, FIG. 09-B4, FIG. 09-B5, FIG. 09-B6, FIG. 09-B7 show the said variety LED or-laser light device has the adjustable kits which in the form of flexible, bendable arm, tube, bar for built-in (has one end install the light device and one end has prong or bulb base) or Add-on (the arm or tube or bar both ends has desired combination for female bulb receiving socket, male bulb base, male prong, female outlet to receiving male prong), so these adjustable kits can allow the LED or-and Laser light kits light beams or sensor head to be position, orientation to desired location and overcome any block-object including depth recess hole, glass shade, heat so can get good lighting emitting, electric signal delivery, depth of hole for recess light bulb-socket location or other any other block-objects.

Figure 8:
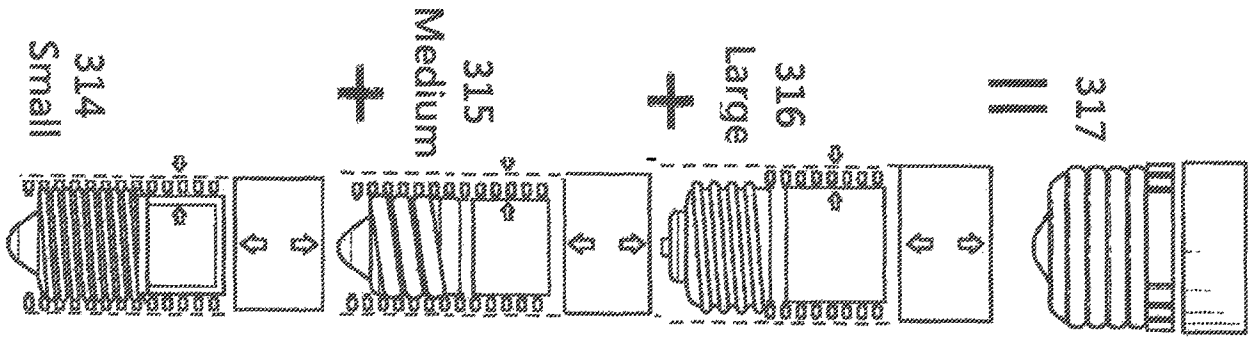
FIG. 08 is an initiative imagery of the said combo-bases, showing the invention to be connected to three bulb bases, and while in the shrunk mode.

FIG. 09-8 and FIG. 09-9 show the LED or-and laser light device which has more than one project assembly and each can project image or lighted patterns from individual project assemblies as co-inventor's co-pending or issued variety US patents. In order to make moving or attractive light effects and save cost to incorporate with motor or movement or moving devices, the current invention apply IC to make each project assembly has different timing to turn-on and turn-off to get the $1^{st}$ project→$2^{nd}$ project□ 3 project by IC and control circuits. The body besides the more than one of project assembly can design as other LED or-and Laser light source for desired light show including color changing, illumination to present any light functions available from market place. It also shown the current invention show the same unit of LED or-and Laser light device can get power from Prong or Bulb base to get power.

FIG. 1 and FIG. 2: Disclosure the $1^{st}$ embodiment of the said project image main constructions for LED night light or LED Bulb has LED light source(s), image carrier(s), project-lens(s) to form the big project image on desired location and emit out from the said LED night light or LED bulb.

FIG. 1A and FIG. 1B and FIG. 1C: Disclosure the 3 embodiment of the said project night light has the wider viewing angle moving project image from the said 3 different moving theory night light. FIG. 1A is use LEDs on time on different time period to change the Light source relative position, orientation to the said image carrier or-and project-lens(s). FIG. 1B is used motor or movement, spin, rotate, moving device to make the said image carrier(s) to moving to make the big project image to moving. FIG. 1C use the magnetic & magnetic-coil with mechanical arms to make the image carrier to moving, shaking, swing to make the said big project image moved.

FIG. 1BB: Disclosure the FIG. 1B for details construction which has movement or motor on bottom with axis long enough to hold and rotate the said image carrier and also allow the LEDs and circuit board along the axis so can allow LED(s) light beam passing through the top optic-lens (change narrow LED light beam to wider and parallel light beam) to hit the top image-carrier and light passing through the image-carrier's opening, cutout, windows, printed window, film, slide, or display or digital data display and go through the top project-lens which may in variety type including but not limited for one refraction-lens or multiple refraction-lens or refraction with reflection lens or any combinations from market available type to create desired light effects. (This drawing same as co-pending filing (# ZZZ-3) U.S. application Ser. No. 14/503,647), FIG. 1CC; Disclosure the FIG. 1C for details construction which has the magnetic & magnetic coil sets to make the magnetic reaction force to pull and push the swing-arm's built-in magnetic unit so can move the swing-arms swinging to make the image-carrier to moving back-and-forth to simulate the sea wave moving effects. The LED light beam pass through the said sea-wave texture image-carrier and emit the tiny image to the top project-lens to magnify to project to wider viewing angle project image on the desire surfaces including wall, ceiling, floor. The moving device here is by magnetic reaction force not from the motor/movement/rotate or spin devices.

FIG. 3, and FIG. 3A and FIG. 3B and FIG. 3C and FIG. 3D and FIG. 3E and FIG. 3F: Disclosure the other embodiment of the said LED bulb for down light, or entrance light, stair light, recess light applications such as FIG. 3A, FIG. 3B, FIG. 3C for normal down light installations. Some of other LED Bulb which may has the block-means from the ceiling, walls, lamp shade which made of cement, concrete, metal, porcelain, pottery or any material which will block out the electric wave, electric signal to transmit though to affect or interfere the LED Bulb operated by Wifi, Bluetooth, internet, App software electric signal delivery so the current invention has different design (FIG. 3F, FIG. 3E, FIG. 3D) has moveable-means such as retractable, extendable, spin, rotate, moving arms, snake house, hinge to move the LED Bulb's at least one level(s) away from (a) Heat (b) light traveling (c) electric signal transmitting (d) all other block-means related to the said LED.

FIG. 4 and FIG. 4A, FIG. 4B disclosure the current invention co-pending filing (# ZZZ-1) U.S. application Ser. No. 14/323,318 which is Continue in Pat filing of (# ZZZ-13) U.S. application Ser. No. 14/023,889 both is related to the wider area image or project image night light with motor/spin/rotating kits to project moving big image.

FIG. 5A and FIG. 5B and FIG. 5C disclosure the preferred $5^{th}$ embodiment which has the basic 3 main construction of the LED(s), image carrier(s), project-lens assembly as all co-pending filing related to one or more than one project filing cases. The current invention had motor/movement to drive axis to rotating and top of the motor has plurality of LED(s) as light source, the LED light beam go through the image-carriers which has one or more than one film/slide/openings/printed windows with or without the holder or disc which is not rotatable or moving. The lighted tiny image from the said image carrier emit to the top project-lens assembly which may be one or more than one which is moving, rotate, spin to allow the tiny-image light beam to fall within each project-lens from one edge to other edge to form the big project image moving on top ceiling or walls or floor from angle N to N−1. The normally the angle depend on how many project-lens inside a round or a disc or dish-shape of carrier or holder. Such as 6 lens arranged on the disc as FIG. 5A, each project-lens around 60 degree, the moving big project image also will show on the surface will has around same 60 degree from appear to dis-appear. This embodiment all parts all fit within the said LED bulb housing parts not as the co-inventor's earlier filing cases the LED, film/slide/displayer/screen, project-lens incorporate with tube or tube-assembly piece. The current invention mainly to fit within the LED light device or-and bulb housing parts only.

FIG. 5B disclosure the alternative arrangement for the rotating multiple project-lens assembly which has a round holder to hold or fix the 6 project-lens each from edge to edge of lens around 60 degree or less so the big project image will move from appear to dis-appear around 60 degree on surface. The difference than the FIG. 5A is the light beam from LED(s) and tiny-image light-beams has the relatively and separate tube(s) to position with each LED(s) and Light output end of lighted tiny-image ends, so the light beams from these 2 sections will not leakage too much to inside of the said housing.

Figure 6:
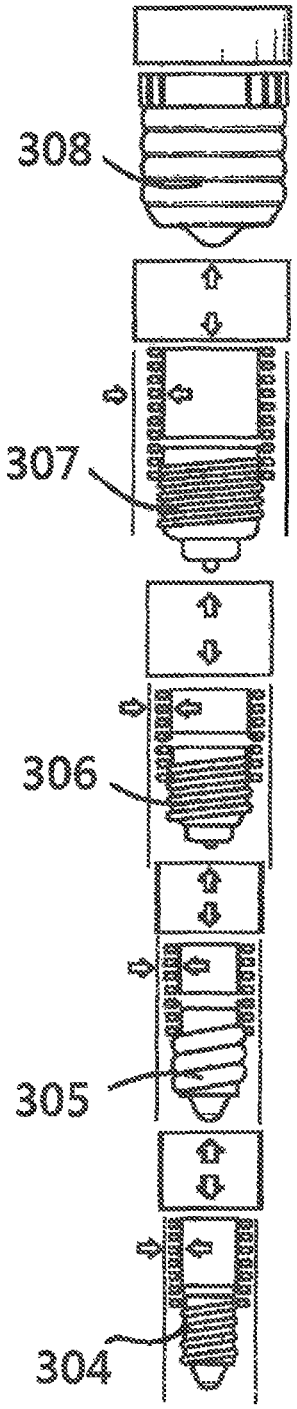
Figure 15:
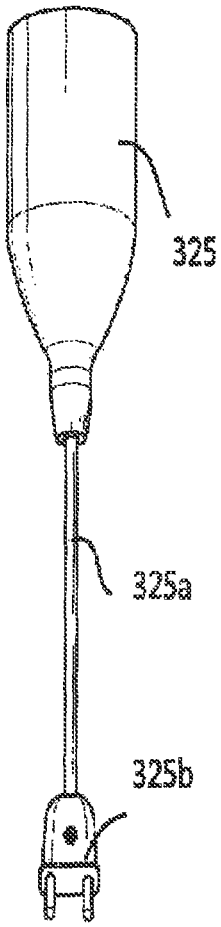
Figure 16:
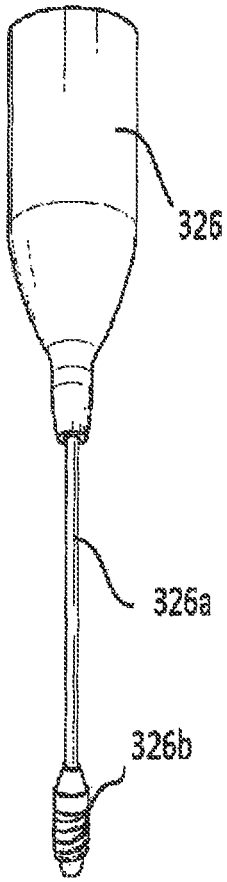
Figure 17:
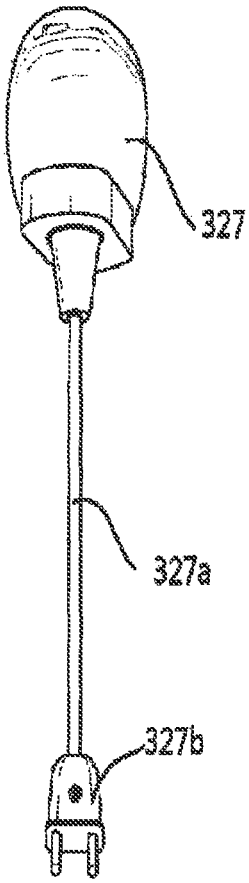
Figure 18:
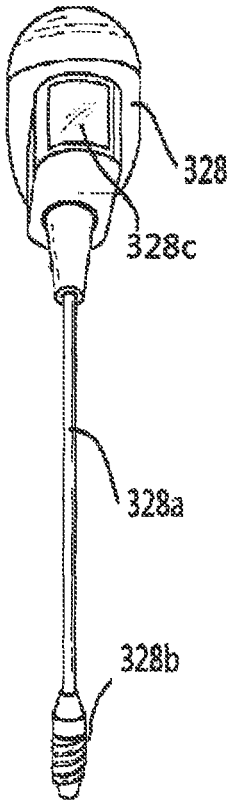
Figure 19:
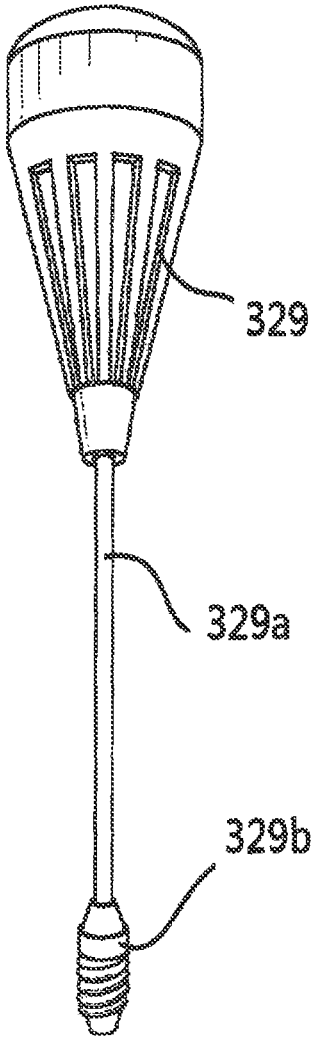
Figure 20:
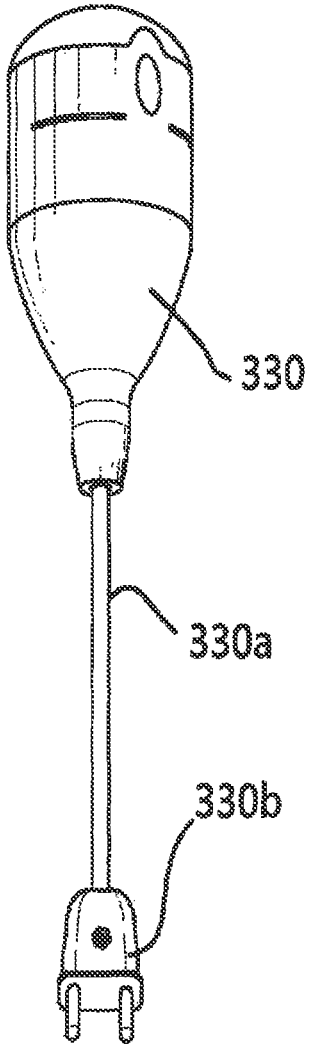
Figure 21:
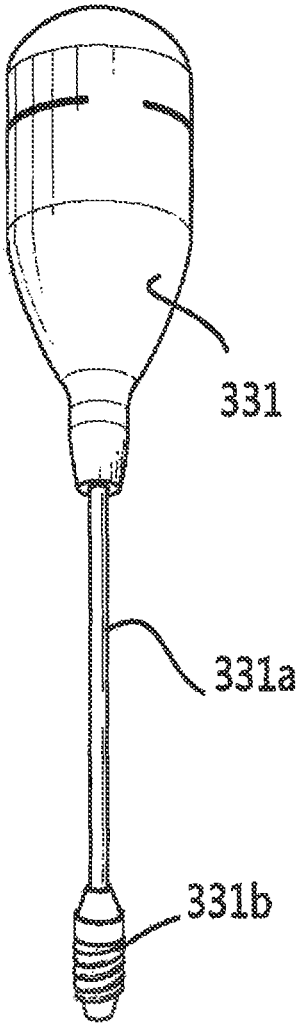
Figure 22:
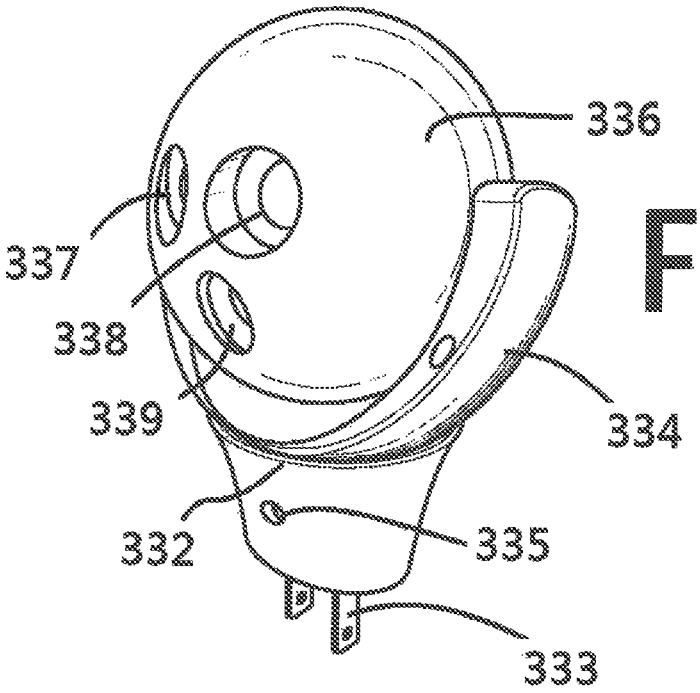
Figure 23:
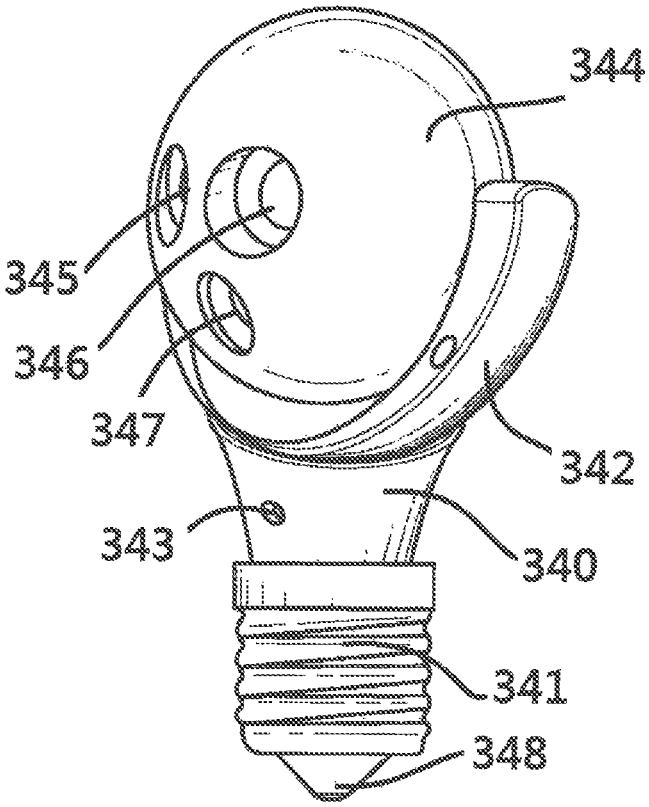
Figure 24:
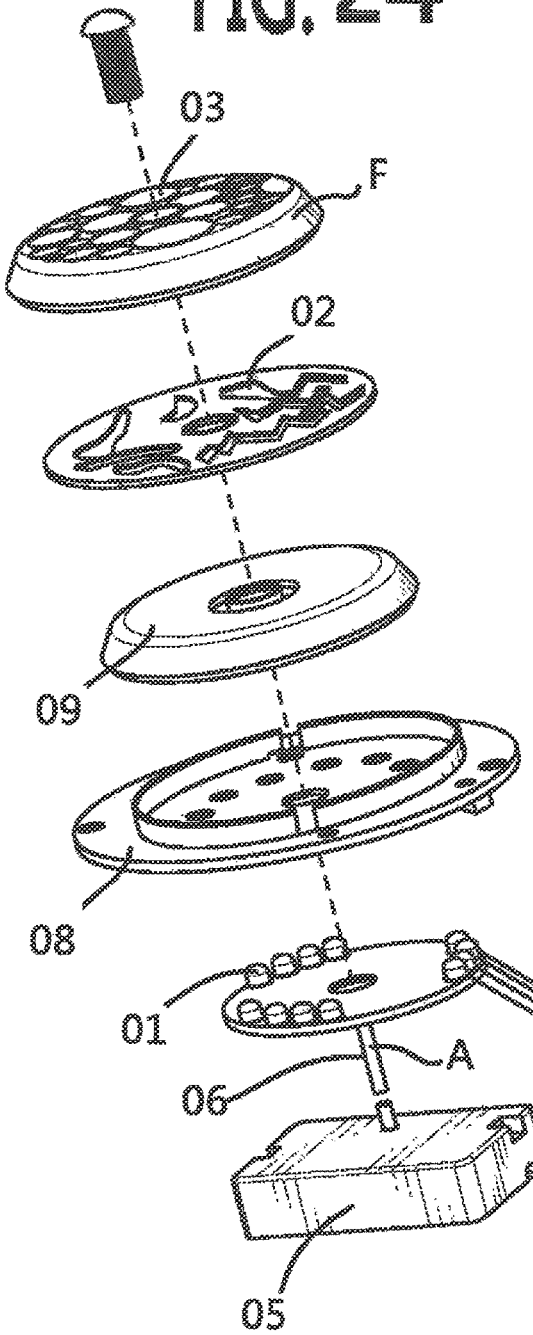
Figure 25:
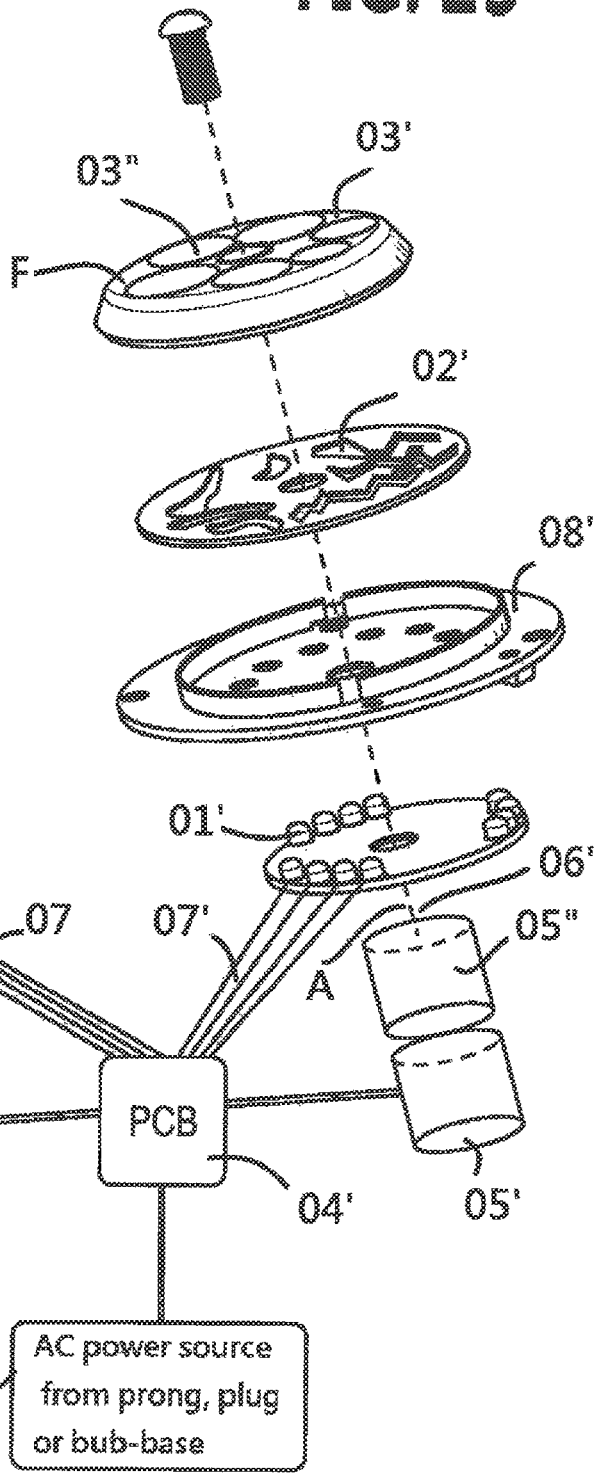
Figure 29:
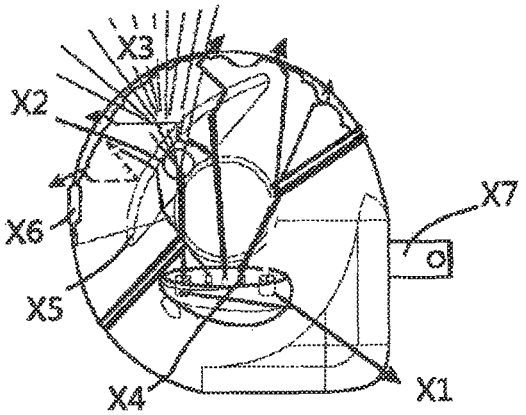
Figure 30:
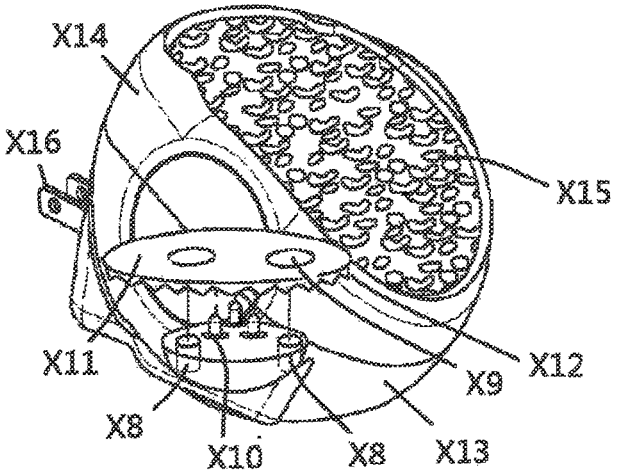

FIG. 6: Disclosure the light theory for the more than one project head same as the co-pending filing that the one project night light or LED bulb has built-in multiple project-assembly like the co-inventor's U.S. Pat. No. 8,083,377 issued date Dec. 27, 2011 FIG. 15 and FIG. 16 has the multiple project head to create multiple big project images on areas or surface. The current invention has plurality of the LEDs and top has image-carrier in one piece or many different film/slide/openings/printed windows/stencils/to allow the LED light beam to pass through for form a lighted tiny-image to go through the top project-lens from number 1 to number N (N-can be same number of top project-lens of the disc or Holder) and from edge to other edge so can see the moving big project image from angle N-appear to Angle N-dis-appear. The above discussed construction for example is one of example but not limited for these limited drawings. It is appreciated all kind of alternative or replaceable or equal function or result or effects still fall within the current invention scope and claims.

The current inventions all drawing are same as above listed co-inventor co-pending or patent drawing with some change on the LED night light or LED bulb including but not limited to has more than one level(s) and use more than one movable-means can make the at least one level's parts or accessories to any desire location, position and orientation. Also, each of level(s) can has one or more than one functions selected from market available LED or LED(s) light effects, function, performance. So it is easily to refer all these concept is same but belong to brand new while become the LED night light or LED bulb applications with all co-pending filing cases' features and concept. It is appreciated all listed co-pending or patented drawing, concept, feature or equivalent or same functions parts/accessories/electric circuit/concept still fall within the current invention for LED night light or-and LED BULB application.

DETAIL DESCRIPTION

From the above background and drawing discussion, the current invention for LED night light or LED Bulb can present a continue moving big projection image to move within certain degree from appear to dis-appear for angle or-and present multiple big project image on the surface at the same time.

The current invention co-pending filing cases already made a big improvement than conventional market available all kind of LED night light or-and LED bulb which only can offer near-by areas illumination not like the current invention NOT ONLY has more than one levels, parts, accessories can change position by moveable-means to make the inventor's LED night light or-and LED Bulb can overcome all kind of block-means which may have happened by (a) heat created by LED(s) or its circuit, electric components light beam block to affect or interfere light traveling (c) signal block to affect or interfere all kind of electric signal transmitting (d) other block to destroy the said LED desire functions, performance, effects BUT ALSO inventor's LED night light or-and LED bulb can use one LED night light or-and LED bulb to offer near-by and far-away illumination or image or both and the said night light or LED bulb also can have other features such as (1) Multiple colors with changeable colors and moving effects (2) Multiple functions select from market available any LED light effects for indoor and outdoor lighting (3) Multiple control which select from market available control, sensor, switch, blue-tooth, Wi-Fi, internet, app software, remote, infra-red or other electric or electronic related circuit or device(s) (4) More than one movable-means (5) Changeable geometric shape (6) Changeable construction (7) moveable select from any group combination from bar, pole, spin, rotate, hinge, arms, joints, join, frame, connector, sections to make the levels, parts, accessories to be move away to desire location, positions. These are the main features of the current invention. The co-pending filing cases already made said LED Bulb has more than one level(s) and has desire level(s) can change position, location, orientation to overcome any block to get the desire LED Bulb functions by variety type of moveable-means.

Also, the current invention co-pending filing cases already has more than one light beam emit out from LED bulb which under more than one control for the one of the light beam may selected from power failure, remote control, Infra-red controller, blue-tooth with mobile phone, Wi-Fi, internet control, app software control, motion sensor to trigger at least one of the light beam to offer the light beam for illumination or image to area(s).

Also, the co-pending filing cases also has other (16) features as below listed:

Features 1: The LED bulb is consisting of:

At least one LED(s) as light source of said LED bulb which emit light beam to desire areas, locations with predetermined illumination, function, time period, performance.

The said LED bulb has parts or accessories for desire group combination select from optic—elements, lens, adjustable focus kits, twisted kits, rotate-kits, elastic contact end, more than one output light beam(s), rotating frame, bulb shade with arms for rotating/tile, more twist bulb base, support for shade, LED assembly, LED tubular kits, adjust kits, project kits, digital data display kits, Lcos display kits, LCD display kits, digital camera kits, data storage kits, data been projected by optics kits, sensor kits, switch kits, IC, circuit, extend, extractable kits, filter, stencil, cutout, painting, motion sensor, Remote control, blue tooth kits, Internet wireless kits to make the said LED bulb emit the light beams, image, time, data, digital message, internet data(s) to desire near-by area(s) or remote-away distance area(s) for illumination.

The said LED bulb connect with power source by contact of base in preferred construction and configuration and incorporate with electric parts & accessories to emit the light beam(s) to areas with adjustable angle cover preferred in x-y-z axis or any combination as required for preferred light performance, effects, functions.

The improvement including:

At one of the output light beam(s) from the said LED bulb can adjust direction to certain area(s), location(s), distance(s) while adjust above listed component(s) of said LED bulb.

The said base of LED bulb is mail insert to fit into the female receiving for desired construction.

The said LED Bulb at least has adjustable parts to make the said at least one of light beam can change position, direction, orientation.

Features 2: The LED Bulb as above listed (Feature #1), the said elastic contact which allow the said LED bulb can adjust the said at least one of the light beam can be position, location, direction to certain area(s) in x-y-z axis.

Features 3: The LED Bulb as above listed (Feature #1), the said extendable, extractable which is The parts can be extend away from the said LED Bulb and has certain configuration and construction to allow install some electric parts & accessories, sensor, motion sensor, remote control, heat sensitive within so can overcome heat, light's shade, light's lens, light's curtain, light's glass, light cover, cavity's depth, or any other block.

Features 4: The LED Bulb as above listed (Feature #1), the said same light beam can incorporate with Optics, optics lens, optics lens assembly with parts & accessories to make the same light beam has different light performance.

Features 5: The LED Bulb as above listed (Feature #1), the focus adjust can make same light beam to present different light performance on the certain location, position, area for desire brightness, size, performance.

Features 6: The LED Bulb as above listed (Feature #1), the said Bulb's frame, support or arms or bar or bendable tube which offer the Bulb can be twist, tilt, rotate, spin, adjust angle and also has hold to overcome any heat issues to make the said change desired angle.

Features 7: The LED Bulb as above listed (Feature #1), the said Base of LED bulb can be in any construction including screw type, pins type, poles type, multiple poles type, twist type, bayonet type, conventional market type for current invention.

Features 8: The LED Bulb as above listed (Feature #1), the said More than one light beam output(s) which the said LED bulb has more than one of the light beam(s) are emit to the location(s), area(s), position(s) which is remote-away from the said LED Bulb.

Features 9: The LED Bulb as above listed (Feature #1), the said LED assembly, LED tubular, Project the construction, parts & accessories which for LED light source so can make the certain LED(s) light beam do not leakage out and passing though the said optics, optics lens, display unit, image, LCD display image, Lcos image, digital display can be emitting out of said LED Bulb to get light beam or image to desire location, position, areas.

Features 10: The LED Bulb as above listed (Feature #1), the said sensor, switch, motion sensor, remote control kits blue tooth kits, photo sensor or other market available electric parts & accessories incorporate the circuit to make the said LED light source to emit light under predetermined light function, performance, effects.

Features 11: The LED Bulb as above listed (Feature #1), the said extend kits, retractable kits can install the select electric parts & accessories, also the LED light source depend on the LED bulb application including up or down or horizon arrangement.

Features 12: The LED Bulb as above listed (Feature #1), the said LED Bulb can illuminate the areas including any combination of areas(s) which are near-by area(s), far-away area(s) or together for both near-by and far-away area(s) effects.

Features 13: The LED Bulb as above listed (Feature #1), the said LED bulbs have more than one functions not only offer the illumination for near-by area or remote-away distance area(s) but also may incorporate with motion sensor, remote control, blue-tooth for other functions.

Features 14: The LED bulb consist of;

At least one LED bulb which has at least one LED(s) as light source to offer the illumination or image while the light source is connecting with related circuit, IC, electric parts & accessories and related switch, sensor, remote control, blue-tooth or equivalent trigger.

The said LED Bulb has extendable to install the electric parts & accessories, extra LED, sensor, control, RF receiving kits, IR sensor kits, or other equivalent control kits to overcome the LED(s) heat, or surrounding block-kits of lighting fixture shade, cover, glass, frame, support, ceiling, wood piece, metal piece, plastic pieces. The said extend can extend to certain distance to away from LED(s) heat or any block-kits to allow the light beams or electric signal delivery direction without interfere by surrounding heat and block-kits to let said LED bulb can has pre-determined function(s), Performance(s), Effects(s).

Feature 15: The LED bulb consist of:

At least one LED bulb which has at least one LED(s) as light source to offer the illumination or image while the light source is connect with related circuit, IC, electric parts & accessories and related switch, sensor, remote control, blue-tooth or equivalent trigger.

The said LED bulb supply the illumination or image to a remote-away areas(s) by angle, position, orientation, direction, focus adjust kits while incorporated with optics, optics lens, project assembly, LED(s) assembly.

The said LED bulb emit the light beam to desire area(s) in preferred combination of near-by illumination, far-away illumination, near-by image, far-away image, digital data image, movie image, internet digital data image, time display, motion picture image, colorful image.

Feature 16: The LED bulb consist of;

At least one LED bulb which has at least one LED(s) as light source to offer the illumination or image while the light source connects with related circuit, IC, electric parts & accessories and related switch, sensor, remote control kits, blue-tooth kits or equivalent trigger kits.

The said LED Bulb has more than one of light beam emit out from the said LED bulb for illumination or image.

At least one of the LED light beam are triggered by control which may select from group combinations from motion sensor, remote control, Infra-red sensor, Bluetooth kits, power failure kits & build in Direct current power storage kits, sensor, switch, or other electric parts & accessories.

The current invention has very details notes on each drawing so here do not discuss details, please refer to attached drawing with brief description below:

From FIG. 01 show the variety different size of bulb-socket which apply for each of LED bulb but has no any LED bulb has more than one of the elastic-male-bulb-bases and can fit into more than one of the female receiving-bulb-sockets at market place. The current invention also create the one LED bulb has more than one male-bulb-base(s) so can use same bulb to fit into more than one female receiving-bulb-sockets. This will save a lot of stores shelves and save a lot of bulb-specification than current market. Such as more than one male-bulb-base can have E10 and E26 2 male-bulb-bases and the smaller E10 can elastic retract-into bigger E26 cylinder-walls and build the electric-delivery by elastic-conductive-spring or metal-piece so the LED bulb can not only fit into E10 female receiving-bulb-socket but also can fit into E26 female receiving-bulb-socket. So market will reduce LED bulb from 2 items into 1 item. This will save a lot of stores space and consumer can easily buy one bulb can fit for different female receiving-bulb-socket.

From FIGS. 02-1, 02-2, 02-3, 02-4, 02-5, 02-6 show the same concept, the small-size (S) male-bulb-base (285) (288) (293) (297) (304) (309) can retract-into or receive-into or fit-into the top medium-size (M) diameter cylinder of male-bulb-base (286) (289) (294) (298)(305) (310). This arrangement make the one male-bulb-base LED bulb become the 2-in-1 2 male-bulb-bases in one LED bulb and can fit into 2 different size female receiving-bulb-sockets.

It also can fit-the medium-size male-bulb-base into the top large-size (L) diameter cylinder (287) (290) (295) (299) (306) (311) so become 3-in 1 male-bulb-base in one LED bulb and can fit into 3 difference size female receiving-bulb-bases.

It also can fit the large-size male bulb-base into the top extra-large size (XL) diameter cylinder (296) (300) (307) (312) so become 4-in-1 male-bulb-base in one LED bulb and can fit into 4 different size female receiving-bulb-bases.

Figure 11:
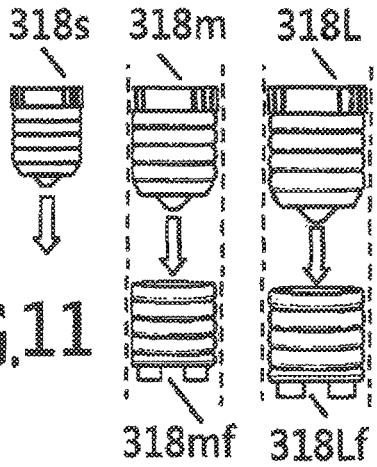

It further can fit the extra-large size diameter cylinder into the top Extra-extra-large size (XXL) diameter cylinder (301) (308) (313) so become 5-in-1 male bulb-base in one LED bulb and can fit into 5 different size female receiving-bulb-bases. This will almost reduce all market place all LED bulb for different male-bulb-base(s) into ONLY one products so only left for only shape difference bulb and each one can fits-into more than 90% female-receiving-bulb-sockets as the FIG. 11A shown.

From FIGS. 03, 04, 05 show the same concept for the small→Fit into→medium→Fit into→Large→Fit into→Extra-large-→Fit into X×L size of the male-bulb-base as FIGS. 11A, 11B, 11C, 11D, 11E, 11F, 11G.

Figure 7:
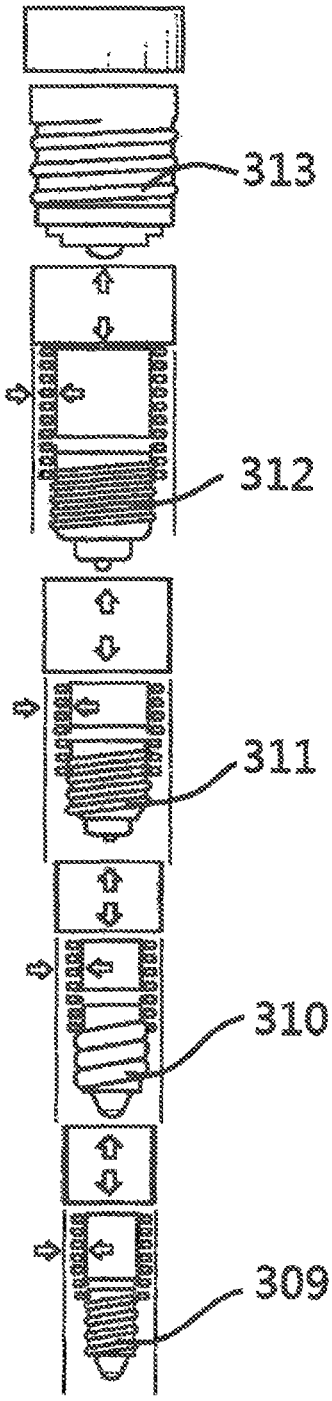
FIG. 07 shows different bulb base (L-pole) insert into to connecting to the bulb female receiving socket of their size, connecting electricity to the said (L-pole) between lowest one towards to the highest one and current can go through the whole bulb.

From FIGS. 07, 08 show the small-size male-bulb-base (318*s*) and medium-size (318M) and large-size (318L) to fit into the female receiving-bulb-socket (318Mf) and (318Mf) which has positive and negative electrodes to connect with the said AC or-and DC power source by (1) prongs (2) AC-plug-wire (3) separated transformer device, or (4) nature power source from solar, chemical, energy or power source.

From FIG. 09, same as the FIG. 05 to show the Top N-in-1 male-bulb-bases (321*s*) (322*s*) (323*s* & 323*m* & 323L) (324L & 324XL) (325XL) is install inside the female receiving-bulb-socket (321*sf*) (322*sf*) (323*sf*) (324LF) (325XLf).

From FIG. 09A and has the elastic-conductive-spring (320SP) shown on front which is within the S (320*s*), or-and M (320M), or-and L (320), or-and XL, or-and X×L size cylinders to build the electric-delivery for N-in-1 male-bulb-bases.

From FIGS. 09-B1, 09-B2, 09-B3, 09-B4, 09-B5, 09-B6, 09-B7 show the different housing of LED light for desired application including seasonal light, seasonal garden light, outdoor garden light or indoor lighting has desired (i) housing, (325) (326) (327) (328) (329) (330) (331) or-and (ii) shape including garden light shape, reading light shape, project light shape, outdoor light shape, bulb-shape, sensor light shape, light has heat-sink or ventilation shape, or-and (iii) construction(s) including garden light, outdoor light, seasonal light, sensor light, LED bulb, reading light, plug-in light, or-and functions including power fail, motion sensor, moving-detectors light photo sensor light, project light, garden light, floor light, or-and (iv) light performance including adjustable brightness, lux, colors, on-off time period, fade-in and fade-out, color-changing, color selection, freeze color, sensitivity, switch on-off to change functions, remote control, wifi controller, USB ports, built-in rechargeable battery, offer energy as power bank, or other market available LED lights related functions, or-and (v) Different conductive-piece to deliver the current to LED light including prong, AC-plug-wire, quickly connector, pig-tail, linkable Plug-wire, twist-bulb-base, bulb-base, fit-tight connector, bendable arms, conductive-wires; Each has different housing and construction for desired LED light which has project the lighted image or-and lighted patterns from inner LED or-and Laser light source.

From FIGS. 09-B1 to 09-B7 the said LED or-and Laser project light device for indoor or outdoor applications including garden light, holiday light, seasonal light, LED bulb applications which has the main light device (325) (326) (327) (328) (329) (330) (331) which has conductive-elements (325*a*) (326*a*) (327*a*) (328*a*) (329*a*) (330*a*) (331*a*) which is a conductive-wires or conductive-metal-piece with or without the bendable-tube, snake-house, envelope, outer-tube to sealed to connect with different conductive-piece including AC-Plug (325*b*), prongs (327*b*), bulb-base (326*b*), pig-tail male-unit (328*b*), linkable-AC-plug (330*b*), snapper (not shown), contactors (not shown), magnetic-connectors (not shown) to get power or current or electric-signal from sources.

From FIGS. 09-8 show the LED or-and laser project light which has more than one lighted image or lighted patterns emit-out ends (337) (338) (339) to project more than one lighted-image or lighted-patterns which can be desired combination for LED or-and Laser lighted-image or lighted-patterns as earlier discussion for fixed or moving or changeable or replaceable or rotatable or moveable for;

image-carrier, or-and (ii) display-units, or-and (iii) movable disc with plurality of image-forming-unit(s) or refractive-lens or grating-films, or-and (iv) texture or treated optics-lens, or-and (v) piece has cut-out, shape holes, openings, or-and (vi) having $1^{st}$ and $2^{nd}$ optics-lens and the light-beam emit out from LED(s) or-and Laser (s) light source go through the $1^{st}$ optics-lens and emit-out to aim to $2^{nd}$ optics-lens to make splendid and spread-out lighted-image or-and lighted-patterns, or-and (vii) has IC and circuitry to make the said more than one LED(s) or-and Laser light source to turn-on and turn-off under (viii) predetermined time, orders, sequential, period of time, duration, cycles, brightness, functions, light-show as market available lighting performance, or-and (ix) incorporating with motor, movement, spin device, rotating device, movement device, magnetic unit and coil for magnetic-reaction device and selected parts and accessories to make the moving or waving or shaking or rotating for lighted-image or-and lighted-patterns, or-and (x) Incorporated with the different 3 basic-parts of project-assembly including LED and image-carrier and refractive-lens for LED light device, or-and laser and grating-piece and protective-lens or cover for laser light device under pre-determined combination for LED or-and Laser project-assembly to make the said desired light performance.

(xi) Having more than one for lighted-image or lighted-patterns emit out including (a) center is one big-Diameter LED project-assembly and surrounded by 6 or more plurality of moving lighted-image or-and lighted patterns. or (b) center is N-number of color or N-different or-and changeable grating-piece of Laser-project-assembly and surrounded by 3 or 6 or 12 moving lighted-image or lighted patterns, or-and (c) the center is one Big LED project-assembly and surrounded by 6 LED moving-project-assembly which can move the image-carrier or-and refractive-lens disc.

From FIGS. 09-9 the said more than one of emit-ends LED or-and laser project device can create hundreds or thousands of lighted-image or lighted-patterns lighted application same as co-pending and division filing for (#11-2) U.S. application Ser. No. 13/540,689 filed on Jul. 3, 2012. Publication data US 2012-026-8668 dated on Oct. 25, 2012, Now is U.S. Pat. No. 8,511,877 issued date Aug. 20, 2013 v.s. Current parent (# ZZZ-2013) U.S. application Ser. No. (# ZZZ-2013) U.S. application Ser. No. 14/023,889 filed on Sep. 11, 2013 now still pending. Now still pending. Which (#11-2009) cover for all seasonal garden light and outdoor lighting, and parent of current invention (# QQQ-2012) U.S. application Ser. No. 13/540,728 filed on Jul. 3, 2012 now is U.S. Pat. No. 8,834,009

(# II-1) U.S. application Ser. No. 13/534,611 filed on Jun. 27, 2012, publication data US 2012/026-8947 dated on Oct. 25, 2012, now is U.S. Pat. No. 8,714,799 issued date May 6, 2014 v.s. Current parent (# ZZZ-2013) U.S. application Ser. No. (# ZZZ-2013) U.S. application Ser. No. 14/023,889 filed on Sep. 11, 2013 now still pending. Now still pending. Which (#11-2009) cover for all seasonal garden light and outdoor lighting, and parent of current invention (# QQQ-2012) U.S. application Ser. No. 13/540,728 filed on Jul. 3, 2012 now is U.S. Pat. No. 8,834,009

This is continue in part of (#11-2009) U.S. application Ser. No. 12/624,621 filed on Nov. 24-2009, publication data US2010/0214541 date Aug. 26-2010, now is U.S. Pat. No. 8,303,150 Issued on 11-6, 2012 v.s. Current parent (# ZZZ-2013) U.S. application Ser. No. (# ZZZ-2013) U.S. application Ser. No. 14/023,889 filed on Sep. 11, 2013 now still pending. Now still pending. Which (#11-2009) cover for all seasonal garden light and outdoor lighting, and parent of current invention (# QQQ-2012) U.S. application Ser. No. 13/540,728 filed on Jul. 3, 2012 now is U.S. Pat. No. 8,834,009

This is Division filing for (# HH-09) U. S. application Ser. No. 12/622,200 filed on Nov. 19-2009, Publication data US 2010-102-8497 date on 5-27,2010 now is U.S. Pat. No. 8,434,927 issued date May 7, 2013 v.s. Current parent (# ZZZ-2013) U.S. application Ser. No. (# ZZZ-2013) U.S. application Ser. No. 14/023,889 filed on Sep. 11, 2013 now still pending. Now still pending. Which (#11-2009) cover for all seasonal garden light and outdoor lighting, and parent of current invention (# QQQ-2012) U.S. application Ser. No. 13/540,728 filed on Jul. 3, 2012 now is U.S. Pat. No. 8,834,009

The above co-pending parent filing (#11-2009) the issued date is later than the both parent filed family (#ZZZ-2013) or-and (#QQQ-2012). The (#11-2009) family show very clear for Seasonal lighting, seasonal light-string, seasonal garden light, outdoor lighting, outdoor garden light with preferred and earlier discussed having desired conductive-piece on the 3 (#II-Family) filed case drawing FIG. 16 of (#II-09) (#IM) (#II-2) that including (aa) AC-Plug wire, (bb) prong, (cc) Bulb-base, (dd) quickly connectors, (ee) pig-tale connector, (ff) magnetic-connectors with desired, (i) wired, or (ii) wireless controller device powered by (1) AC or DC power source (2) outside transformer (3) solar powered with its rechargeable battery or energy storage device.

From FIGS. 09-8 and 09-9 both show preferred conductive-piece which can has (1) prong (333), or (2) AC-plug-wire (333) and wire is arrange within the base and can pull out or retracted-received the base, or (3) bulb-base (348). Also, has the desired sensor unit(s) (335) or (343) to turn-on and turn-off the said LED or-and laser light source under pre-determined functions, colors, brightness, lighted-image or-and lighted-patterns.

Figure 10:
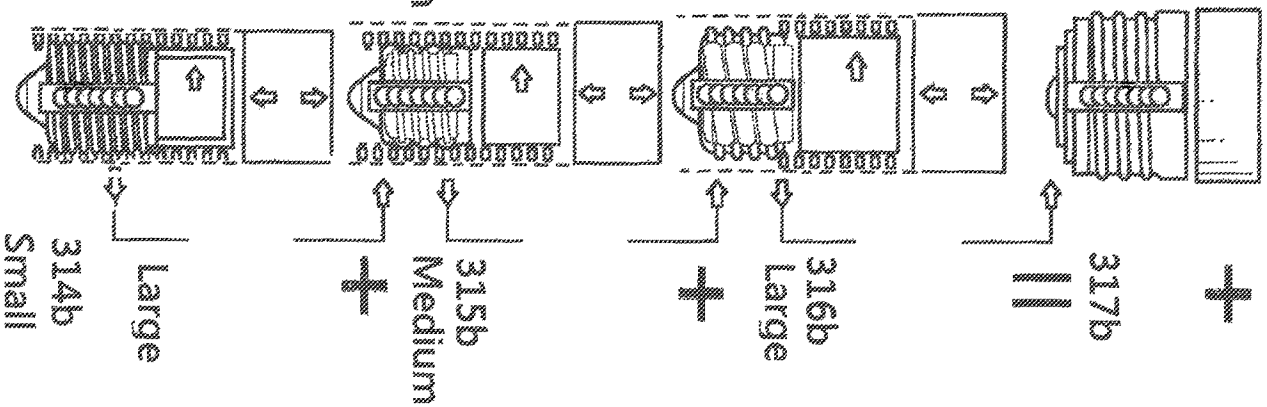
Figure 12:
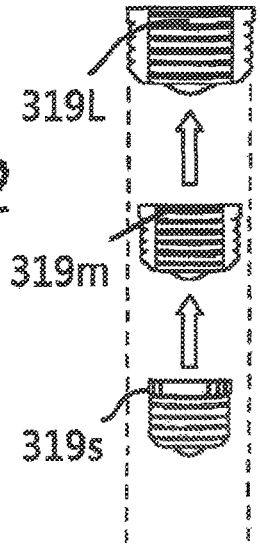
Figure 14:
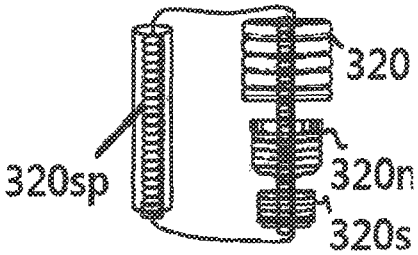
Figure 13:
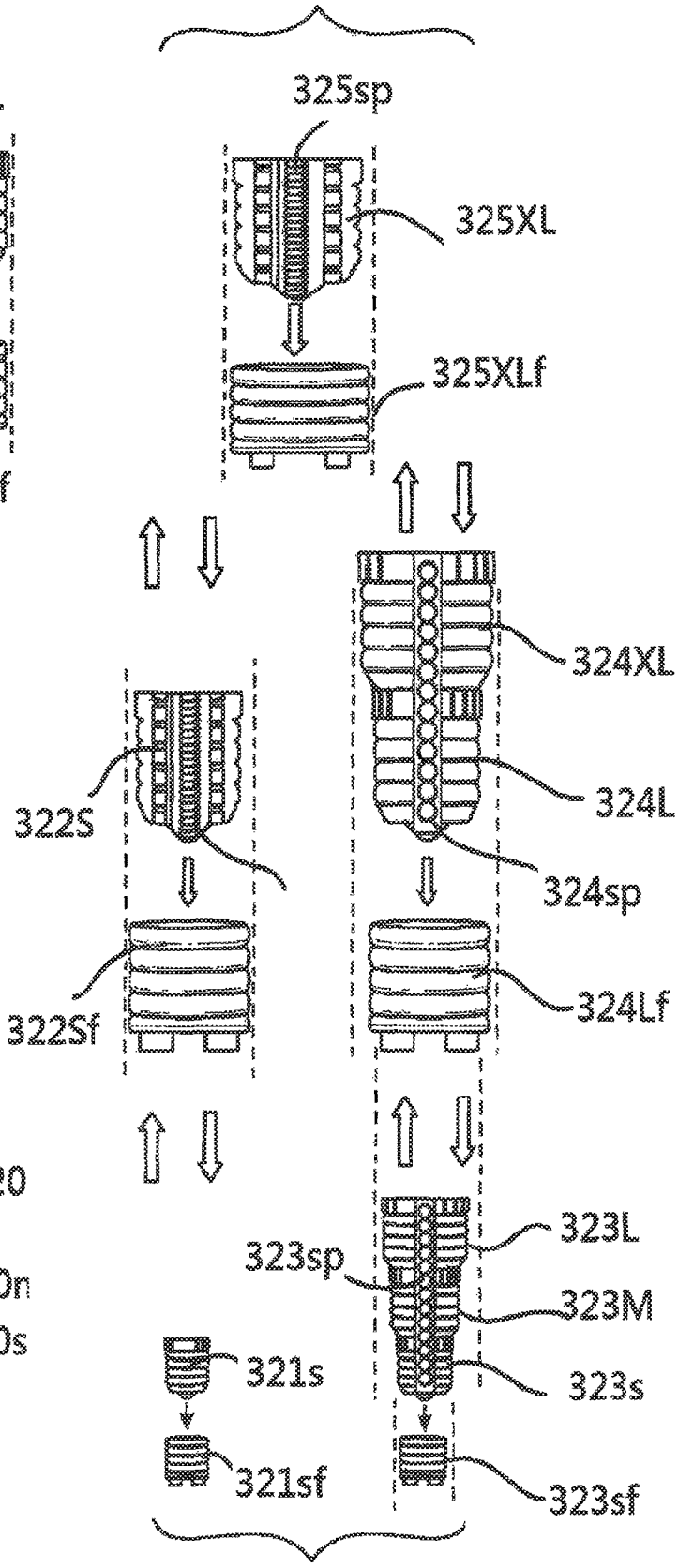

FIG. 1 and FIG. 2: Disclosure the $1^{st}$ embodiment of the said project image main construction for LED night light or LED Bulb has LED light source(s) (01), image carrier(s) (02), project-lens(s) or project-lens assembly (03) to form the big project image (not shown) on desired location and emit out from the said LED night light or LED bulb. All the current invention or the co-pending applications of the said projection LED light device(s) all still use the optic theory of the FIG. 10 and FIG. 11 and FIG. 12 only different for the three main projection theory 3 major parts to apply to the current invention for LED light source(s) (01), image carrier(s) (02), project-lens(s) or project-lens assembly (03) (*i*) put on different location, or (ii) has different construction, or (iii) arranged fit on tube or housing parts, or (iv) incorporated with IC or desired circuit, or (v) has motor/movement/spin/rotating device; to make the said 3 major parts (a) to change position, or (b) has track, groove, ditch to make the manual or automatically adjust the optic-lens to adjust the focus, or (c) has moving parts to allow adjust the project image angle, or (d) other features listed or discussed inside of all co-inventor's earlier applications cases.

From FIG. 1 the said movement (05) which is super silent without noisy device which has axis (06) has elongate length to install the LEDs (01) or-and its base or circuit board which connect with the PCB (04') which has the electric parts & accessories to control the LEDs to has desired function including chasing, random, pair flash, sequential, random flash, fade-in and fade-out or any LEDs light function available from market place.

The LEDs position with the optional top position-board (08) which has walls can fit with the preferred or optional other optic-lens which main purpose is to make each LED's narrow LED light beam to become wider viewing angle LED light beam so can cover to the as wider as possible wider range light beam can emit to the said image carrier (02) so can get shaped light beams to pass through the opening(s), printed window(s) which is not punch-through, cutout(s), films, slides on the said image carrier (02).

The shaped or tiny image light beam out from the said image carrier (02) (02') will emit to the said top project-lens (03) (03") or project-lens-assembly (F) (03) which can be a single project lens (03) (03") or plurality of the optics-lens (03) (03") to form into one assembly (F).

The project-lens (03) (03") or project-lens-assembly (F) has at least one optic properties been the refraction the shaped or tiny-image light beam to wider viewing angle image has the desired brightness, color, image, shape, moving.

The said big or wider viewing angle project-image (not shown) show on the certain distance away from the said all kind of LED light or from the same construction put inside different outside housing for all kind of LED lights for indoor and outdoor applications such as into a LED bulb shape and connect with the power source from the LED bulb's base which may be an update retractable contact point allow people to twist one more or more circles to let the can have desired position or orientation.

From FIG. 1, one of alternative embodiment including the axis (06) of the movement (05) extend to top and go through LEDs or-and circuit board or-and top position tray (08) with wall to install the optic-lens (09) and prevent light beam leakage out. And all these parts including LEDs (01), circuit board, top position board (08), optics-lens (09) all is not rotating for this embodiment. Only the image-carrier (02) is moving, rotating, spin with the said movement (05) axis (06) and speed can be design as wish.

The moving image carrier (02) will allow the below LED(s) (01) light beam to pass through the different portion of the said image carrier (02) and the shaped or tiny-image light beam will be come out from the openings, cutouts, film, slide, printed windows (not punch through) to emit to the top pluralities of optics-lens-assembly's (F) which has desired big viewing angle from more than 90 degree to 360 degree with one or plurality of project-lens so can project a super big size of the project-image on the desired surface including ceiling, walls, floor, outdoor locations, garage door, fence, garden to show out moving effects or the said shaped or tiny-image light beam out of the said image-carrier (02).

The said FIG. 1 the said shaped or tiny-image light beams while pass through the top one (03) (03") or plurality of optic-lens assembly (F) project-lens (03) (03") which will be refracted (as FIG. 1A) the all shaped light beam to random directions (x3) with different shaped light patterns while the image carrier has shape openings (as FIGS. 1 and 2) or cutout (as FIGS. 1 and 2) or printed windows (not punch through as openings), those are not film or slide so it looks like the aurora effects with moving effects which are created by the moving image-carrier (02) (02'). The current embodiment is only one of the application it should not limited to for other or alternative or equal construction embodiment to make the image-carrier (02) (02') in any construction to be rotated, spin, moving.

From FIG. 1, The alternative arrangement can make to move any combination select from group including LEDs (01), or-and image-carrier (02), or-and circuit board, or-and optional top position board (08), or-and $2^{nd}$ optics-lens (09) to make different function and light effects.

The moving image carrier (02) will allow the below LED(s) (01) light beam to pass through and create lighted-patterns or lighted-image(s), where the image-carrier (02) (02') is a desired (i) display-unit, or (ii) image-forming unit, or (iii) a piece has different portion or section or area of the said image carrier (02) including the slide (02), film (02), stencil (02'), piece has shaped-openings (02), piece has cutouts (02'), texture lens (3), lens has treatment(s) (3) or diamond-cut of FIG. 1A.

From FIGS. 1A, 1B, 1C show the optional top cover (x6) or front cover (x15) or outside parts (x21) or housing (x21) which has big open-end allow light beam emit out from more than 90 degree to 270 degree or for ball type outer cover is 360 degree for ball open-end. So, light can passing through project-lens (x2) (x15) (x21) or protective-lens (x21). The top or front lens (x2) or cover (x15) or housing (x21 with desired shape such as dome, sphere, ball, at least half ball so can project out lighted-image or patterns from top or front cover or parts or housing to outside areas or surface has a super big size of the project-image or lighted pattern(s) on the desired surface including ceiling, walls, floor, building, house, fence to show out (1) desired fixed or-and moving effects or (2) the said desired shaped or lighted full color image or colorful desired light-beam assorted while the LED (x4) (x10) (x17) or-and laser light source (x1) (x8) through of the said image-carrier (02) (02').

From FIG. 1, the axis (06) of the movement (05) extend to top and install LEDs (01) and circuit board and top position board (08) with wall to install the 2nd optic-lens (09) and all these parts including LEDs (01), circuit board, top position board (08), 2nd optics-lens (09) all is not rotating for this embodiment. Only the image-carrier (02) is moving, rotating, spin with the said movement (05) axis (06) and speed can be design as wish. The alternative arrangement can make to move any combination select from group including LEDs (01), or-and image-carrier (02), or-and circuit board, or-and optional top position board (08), or-and $2^{nd}$ optics-lens (09) to make different function and light effects.

From FIG. 2 very similar with the FIG. 1 but the rotating or moving unit is the said Top Project-lens or project-lens-assembly (F) not the said Image carrier (02').

From FIGS. 1, 2, 1A, 1B, 1C the said image-carrier (x5) (x11) (x20) may has opening (x9), shape hole (x19), windows (not shown), printing piece (x9), film (x9), slide (x9), texture (x12) (x11), variable thickness (x12), sand blaster (x11), or any other market available image forming unit or lighted patterns forming unit or display unit. Wherein the image-carrier (02) (x5) (x11) (x20) may has different shaped-hole (02) or stencil (02') or variable thickness (x12) (x15) or treated lens (x11) (x5) or plurality of tiny-sections/ areas/parts (x15) has treatment such as prism (x12) or diamond-cut (x6) which has flat-inside and curved outside to form the convex-lens for refraction function, and To form the lighted patterns or-and image, or while the image carrier (02) (02') (x6) (x11) (x20) has shape openings (x19) or cutout (x9) or printed window (x12) not film or slide with proper design for cut-shape and number and rotating-speed to create the lighted patterns can be look like the aurora effects with moving effects which are created by the moving image-carrier (02)(02') (x11) (x5) (x20).

This FIGS. 1, 2, 1A, 1B, 1C is the one of the plurality of indoor or outdoor LED light application, it should not limited to for any other construction which has alternative or equal construction or replaceable embodiment for optics-lens, optics-elements (not lens), or other movement device or use changing sequential LEDs to make moving effects; these alternative or equal function for LED light device to make variety vision moving effects or moving effects created by the different treatment of the optics-lens or image-carrier to be rotated, spin, moving should be fall within the current invention claims coverage.

The FIG. 1 the optics-lens (03) can be a variable thickness convex-lens which has different diameter or shape or different thickness so can make a plurality of different lighted-patterns from one or multiple color LED light beams came out from one or more than one LEDs for outdoor lighting applications powered by prong or bulb base or AC-plug wires to get AC power source.

The said FIGS. 1, 2 shaped or tiny-image light beams came out from image-carrier (02) (02') and pass through the top plurality of optic-lens assembly (F) which has one or more than one of project refractive-lens (03)(03')(03") which will be refracted the all shaped light beam to desired or random directions as pre-determined specification or function or light effects. And the shaped or tiny of lighted-image or light patterns' light beam come out from the openings (02), cutouts (02'), film (02'), slide (02), diamond-cut (x6) as FIG. 1A, or texture lens (x5), variable thickness lens (x12) (x15), printed windows (x9) to emit to the top plurality of optics-lens-assembly's (x6)(x150(x21) which has optics-properties including (i) diffusing (x15) as FIG. 1B, or-and (ii) refractive (x6) as FIG. 1A inner of cover, or-and (iii) reflective or-and refractive lens (x6) (x15) (x21) as FIGS. 1A, 1B top cover lens;

To create at least one of big viewing angle image or lighted patterns

From FIG. 2 very similar with the FIG. 1 but the rotating or moving unit is the said Top Proj ect-lens or project-lens-assembly (F) not the said Image carrier (02').

The different arrangement or rotating unit from the image carrier (02) to change to project-lens (03') or project-lens-assembly (F) will form the different light effects. To rotating the project-lens (03') or project-lens-assembly (F) (03') will get the shaped or tiny-image out for the image-carrier (02) (02') to pass through the top each single optic-lens (03') of the multiple optic-lens assembly (F) so can get one by one image on the different location and look like continue image moving for certain degree such as 6 optics-lens assembly (F) can get around 60 degree moving image. This has details design description on the FIG. 6 for LED bulb or outdoor garden light applications connected by prong or LED bulb socket or AC-plug wire to AC power source for outdoor application. Same as FIG. 1, the FIG. 2 embodiment has the 3 major components for LEDs (01') and Image-carrier (02') and Project-lens-assembly (F) all fit along with the below motor (05') and motor gear set (05"). The motor has very faster rotate cycles per minutes (RPM) so need one motor gear set (05") to reduce to preferred RPM so people will not see too quickly rotating or moving project-image feel bad. The LEDs (01') fit on the circuit board and LED(s) light beam emit through the optional position board (08') or other design frame (FRA), support (S), holder (H) or has the other optics-lens (not shown) to make the narrow LEDs light beam to become wider viewing angle LED light beam and pass though the said the top of the LEDs position board (08') has the image carrier (02') which same as the FIG. 1 has the preferred shaped openings, cutouts, stencils, film, slide, display-unit so can allow the LEDs light beam to pass and emit the said shaped or tiny-image light beam to the said each single project-lens (03") to form the image and because each single project-lens (03") is rotating so the shaped or tiny-image light beam will go though one by one of the single optics-lens (03") to form the image on different timing and angle so can form a continue same big project-image shown on the surface.

From FIG. 2, to rotate the said project-lens (03') or project-lens-assembly (F) which has number of the single optic-lens (03") and while the shaped or tiny-image light beam has sufficient wider angle so can pass through the many of the said the single optic-lens (03") because optics-lens (03') is rotating so the image will be same and the look like same image continue show up and moving from one circle side to other circle side. The moving direction can be clockwise or anti-clockwise which depend on the below motor or movement or spin device, rotation direction. The number of the shape or opening or cutout or printed window or film or slide or the display-unit and its related LED number to form the lighted shape or tiny-image light beam also will get the number of big project-image. The alternative application for outdoor garden light or LED bulb shown on the FIGS. 5 and 6 to show the details concept how to make multiple or plurality LED-lens for projection construction and effects and light-beam traveling path discussion.

More detail for the moving Project-lens or project-lens-assembly (03) for lighting effects shown on the FIGS. 5 and 6 with more details.

From FIG. 2 very similar with the FIG. 1 but the (a) rotating or moving unit (05') (05") and (b) top Project-lens (03') or project-lens-assembly (03") not same as the FIG. 1 to move or rotate the said image carrier (02'). The FIG. 2 show the different arrangement or-and rotating/move/spin units (05') (05") from the FIG. 1 show to move the said image carrier (02).

Same as FIG. 1 and FIG. 2 embodiment has the 3 basic or major parts or components for project-assembly including LEDs (01') and Image-carrier (02') and Project-lens-assembly (03'), and all assembled and fit within the desired housing for desired applications including indoor or outdoor LED project-light such as garden-light, seasonal-light, patio-light.

From FIG. 1A show the co-pending filing case with the alternative way to create a wider viewing angle project-image on the surface. This embodiment use more than one optic-lens (x5) (x6) has at least one is refractive lens (x5) to make the LEDs (x4) light beams to pass though the $1^{st}$ lens (x5) to get narrow LEDs (x4) light beam to become many of refraction light beams and the said many refraction light beams go through the outside $2^{nd}$ lens (x6) to make the wider viewing angle project-images. The said $1^{st}$ lens (x5) may also have texture which can be a wave type and the LEDs can be more than one of Blue-light and Green-light or white-light LEDs (x4) with IC (not shown) controller to make the said LEDs (x4) color changing on desired time period with desired functions and speed and brightness may select but not limited for fade-in and fade-out, chasing, pair-flashing, random, automatically changing function, freeze function, sequential or other market available LED light functions still fall within the current invention's scope for outdoor garden or outdoor project light or indoor project light applications.

The FIG. 1A, the green, white, blue, color 3 LED (x4) light beam emit to the wave texture optical lens (x5) which is has reflected and refracted all the LEDs light beam and go through the $2^{nd}$ Wave or other texture refraction optic lens (x6) so came out many of the light beam (as arrow head-lines), and when the light beam came out from 1" optic lens (X5) and pass though the $2^{nd}$ lens then can come out a lot of wave shaped or other patterns of blue, green, white project image. While the blue, green white LEDs (x4) are turn on and turn off on different time period and from $1^{st}$ Blue to $2^{nd}$ green to $3^{rd}$ white with preferred fade-in and fade-out sequential, or others LEDs arrangement with 1→2→3 front and back, then, can create the moving water wave effects so this is use non-motor devices to make a big viewing angle moving project-image is the one of plurality of the current and co-invention application features and other equal function or alternative arrangement or replaceable construction should be fall within the current invention for moving project-image scope.

From FIG. 1A show the co-pending filing case-(# ZZZ-3) U.S. application Ser. No. 14/503,647 filed on Sep. 11, 2013 now is U.S. Pat. No. 9,719,654 issued date Aug. 1, 2017 which is Division filing of (# ZZZ-2) U.S. application Ser. No. 14/451,822 filed on Aug. 5, 2014, which is Continue In Part filing of -(# ZZZ-1) U.S. application Ser. No. 14/323,318 filed on Jul. 3, 2014 which is Continue In Part filing of (# ZZZ-13) U.S. application Ser. No. 14/023,889 filed on Sep. 11-2013 which For LED or-and Laser light device has 1" and $2^{nd}$ Optics-lens and light beam Passing through 1" and $2^{nd}$ optics-lens with or without motor or movement to create steady or moving lighted patterns or lighted image. The application as co-pending (#11-2009) (# II-1) (#II-2) for outdoor lighting, outdoor garden light, seasonal outdoor light, seasonal Christmas or Halloween light, or garden light, or outdoor garden project light, outdoor garden floor light with adjustment angle or focus with IC to make fade-in and fade-out or time delay functions with one or more than one size images or lighted patterns with preferred conductive-piece including prong, AC-plug wire, USB wires, solar power module with energy storage units.

It is the alternative way to create a wider viewing angle or-and super bright project-image on the surface. This embodiment use more than one optic-lens (x5) (x6) has at least one has refractive or-and refractive optics-properties lens to make the LEDs (x4) light beams to pass though the 1st lens (x5) to change the narrow emit-out-angle LEDs light-beam to become many light-beam after go through the said Pt of reflective (x5) or-and refraction (x5) optics-lens (x5) and the said many light-beams emit-to and go-through the outside $2^{nd}$ project or protective lens/cover (x6) which has big-arc (x6) or big-angle (x6) or flat-piece (not shown) or preferred shape including (i) dome, half ball, or at least 1.2 ball, sphere those has desired optics properties including reflective or-and refractive (x6) or-and diffusing (x15) or-and convex lens (x6) or-and made with plurality of small sections/areas/piece to form a optic-function piece (x15), or a sphere outer-piece (x6) just for protection/environment/waterproof purpose only; or, even (ii) flat-piece (not shown) for just protection purpose to make the more wider viewing angle project-images or-and lighted pattern(s) to shown on outside the LED light, or LED bulb, or LED garden light, or other LED outdoor, or LED indoor lighting device.

The said $1^{st}$ lens (x5) may also has texture which can be a wave type and the LEDs (1) can be more than one of blue-light and green-light or white-light LEDs (x4) with IC or-and controller to make the said LEDs color changing on desired time period with desired functions and speed and brightness may select but not limited for fade-in and fade-out, chasing, pair-flashing, random, automatically changing function, freeze function, sequential or other market available LED light functions still fall within the current invention's scope.

The FIG. 1A, the alternative color for the red, blue, green color 3 LED(s) (x4) or one LED has multiple color(s) while the light-beam emit-to the wave or desired texture optics-lens (x5), the LEDs light-beam go through the wave or others texture reflection or-and refraction optic-lens (x5) so came out many of the light beam and pass though the 2nd lens (x6) then can come out a lot of wave or other patterns with desired shaped blue, green, white project image to garden, garage door, fence, building, ceiling, walls, floor from LED garden light, floor light, light string, seasonal light and get power from prong, AC plug wire, bulb base for AC current or from outside transformer to get DC current.

While the blue, green white LEDs (x4) are turn on and turn off different time period; For example turn on the $1^{st}$ red and $2^{nd}$ blue and 3rd blue or any mixed-colors for different percentage of light-color and time, it can create hundreds of color and it also can select the preferred (a) fade-in, or (b) fade-out, or (c) sequential-flash, (d) LEDs arrangement with 1>2>3 or any of 1+2>1+3>2+3, or (e) other any combination; can created the many different assorted color.

Wherein the colors also can create like (i) minimum 7 or 14 color of rainbow, or-and with more added-colors as pre-determined IC design, or-and (ii) this different-color turn-on $1^{st}$ and $2^{nd}$ or front and back, then, can create the moving water wave effects; so this is one example for creating moving effects but this embodiment use non-motor device to make a big viewing angle moving project-image is the one of the current and co-invention application features and should be fall within the current invention for moving project-image scope.

From FIG. 1B and FIG. 1BB; The FIG. 1B show the outside shape with LED or-and laser light-beam traveling path for different optics-properties lens, and FIG. 1C show the FIG. 1CC details mechanical construction how to make the moving project-image like the said Aurora or any other preferred stimulate nature scene including galaxy, solar system or others which is similar or it is alternative or equal function or replaceable example as the said preferred embodiment of FIG. 1B.

The said FIG. 1A has the top or front or outside parts or housing (7) which has sphere or at least ½ ball, dome or flat-piece which has wide arc or angle around 90 or 180 or 270 degree project/or protective/or refractive or-and reflective (x6) or-and diffusing (x15) lens which are formed by plurality of small area/segment/parts/piece variable lens thickness piece (small piece inside x15) into a top/front/housing/flat cover/flat diffusion cover (x15), the said top cover/front cover/housing piece (x15) is similar or alternative or replaceable with the optic-lens like FIG. 1(F) plurality of small areas/segments/parts with different thickness convex lens to make the disusing function of the FIG. 1B and FIG. 1BB, and The said each small segments/areas/parts of one preferred optic-lens (x6) of FIG. 1A and each of plurality of the small segment/area/part has its focus and thickness and curvature of the lens (x6) so can make the plurality of the different reflective and refractive light effects.

The said inner construction as the above discussed FIGS. 1, 2, the main 3 components LEDs, image-carrier, project-lens form the project-assembly as above discussion for current LED project light applications for outdoor lighting or outdoor garden or outdoor light string as parent filed for (#1I-2009) (#II-1) (#II-2) for all application with these 3 major project 3 parts.

The current invention and all the FIGS. 1A, 1B, 1C, 1BB, 1CC has (i) prongs or alternative or replacement or equal function conductive-metal-piece without or with wire available at market place such as (ii) bulb-base, (iii) AC wired with plug which use AC plug wire; to connect with AC power source for LED garden light, LED outdoor light, LED indoor light also still fall within the current invention. The FIG. 1A, 1B, 1C, 1BB, 1CC show the LED light beam passing through the image-carries image-forming unit or display unit or above discussed treated lens or others to become a big viewing angle projection night light, indoor or outdoor LED project light, LED bulb.

From FIG. 1B and FIG. 1BB which FIG. 1B show the outside shape and FIG. 1BB show the details construction how to make the moving project-image like the said Aurora as the said preferred embodiment of FIG. 1. The said FIG. 1 has the top wide angle around 180 degree project-lens which are formed by plurality of small optic-lens like FIG. 1 and each small optic-lens has its focus and thickness and curvature of the lens so can make the different reflective, refractive light effects. The said inner construction as the above discussed FIG. 1, the main 3 components LEDs, image-carrier, project-lens-assembly as above discussion. The current invention and all the FIG. 1A, FIG. 1B, FIG. 1C, FIG. 1BB, FIG. 1CC has prongs or AC plug wire or bulb-base or outside transformer to supply power to said LED project light for indoor or outdoor use and light beam through the $1^{st}$ and $2^{nd}$ optics lens to become a big viewing angle projection LED all kind application light. While the same 5 above discussed embodiment constructions of the major 3 components fit into the Bulb shape housing with bulb-base can instantly become the LED Bulb has the moving project-image LED bulb. The power source come from wall outlet or from the bulb-base power source just through the different conductive prong or conductive bulb base. So, all the current invention coverage for LED plug-in night light or the LED bulb with conductive bulb base or AC-plug wires LED light for all kind specification should be still fall within the current invention. So all the preferred embodiment has prong is equal has the bulb base also equal the AC-plug wire, and with preferred different housing selected from any geometric shape can instantly change from LED projection light to a night light, garden light, bulb, accent light, floor light, patio light, light string, seasonal light string for not only offer illumination but also projection light effects.

From FIG. 1BB-show the alternative construction for the FIG. 1BB which has different base (W) and top $2^{nd}$ optics-lens act as top cover (W7) and both assembly with middle housing frame (W6) together. The said rotating $1^{st}$ optics-lens (W4) can be a ring or tray type (W40) or a piece type (W4-1) act as rotating image-forming unit to create the movable and changeable $1^{st}$ image while the lower position LED (W3) emit light beam to the rotating $1^{st}$ optics-lens. The light beam came out from rotating $1^{st}$ optics-lens emit to the top $2^{nd}$ optic-lens as top-cover (W7) which is refractive or-and diffusion or-and reflective optics-properties to create the splendid light effects. The said rotating $1^{st}$ optic-lens which is connect with the lower movement device (W1) which may is a motor or movement or other rotate unit (W1) with axis (W2) to fix the rotating 1' optic-lens and assembled the rest of the parts by frame or holder (W8).

From FIG. 1C and FIG. 1CC is outside shape and details construction show the other alternative way to get the moving project-image for LED all kind of light including night light or the LED bulb for bulb receptacle or light strings applications. Again, this is same as Co-pending filing case (#ZZZ-3) U.S. application Ser. No. 14/503,647 which apply the same 3 major components LEDs (201"), image-carrier (202"), and Project-lens assembly (203") to form the big viewing angle project-image by electric magnetic force to pull or push the vibration, shaking, swing, waving, moving part (202B), arm (202B), pole (202B) craft (202B), axis (202B), bar (202B), pole (202B) connect with magnetic unit (202A) which will be affect or reaction to the said magnetic-coil device (202E) while the different current passing through the said magnetic-coil (202E) to create magnetic field and force to pull or push the magnetic-unit (202A) for close or pull away. So, the magnetic-unit will bring the attached, connected, joint-together said moving part (202B), arms (202B), pole (202B), craft (202B), axis (202B), bar (202B), pole (202B) to be waving, shaking, swing, moving to make the $1^{st}$ optic lens or image-carrier (202") has desired all kind of texture or without texture to be change position to make the said desired light effects. The said moving parts (202B) is attached on the $1^{st}$ optic-lens or image carrier (202") two sides pole (202C) while the moving parts (202B) is moving and the two sides pole (202C) sit on the two side frame (202D) will be also change position so make the said $1^{st}$ optic-lens or image-carrier (202") moving so make the image carrier $1^{st}$ optics-lens (202") to emit the different light beams to the top project-lens (203") and form the big viewing angle project image on the desired floor, ceiling or walls, building, garage door, outdoor walls, but not shown on the wall where has the outlet or surface has the bulb base or AC power AC outlet.

From FIG. 1CC show the one of alternative or replaceable or equal function arrangement to make moving function by electric magnetic-force to pull-or-push or motor-sets to move the (i) optic-lens (203"), or-and (ii) image-forming unit, display unit (202"), or-and (iv) LED (201") to make vibration, shaking, swing, waving. The said 3 basic-parts of project-assembly may incorporate with related-parts for all LED project light basic parts and incorporate with one or more parts and accessories selected from moving part (202B), arm (202B), pole (202B), craft (202B), axis (202B), bar (202B), pole (202B) connect with magnetic unit (202A) which will be affect or reaction to the said magnetic-coil device (202E) while the different current passing through the said magnetic-coil (202E) to create magnetic-field and force to pull-or-push the magnetic-unit (202A) which may connected with LED (201") or-and image forming unit(s) (202") or optics lens (203") for close- or pull-away to make the 3 major components to make moving in x or-and y or-and Z-axis for 3 dimensional movement for all kind of LED indoor or outdoor light applications to make desired functions.

From FIG. 1CC, The current invention is one of the plurality of embodiments but not limited for all the magnetic-unit will make the attached or connected or joint-together said moving optics-lens (202") (203") or part (202B), or arms (202B), or pole (202B), or craft (202B parts or), or axis (202B), or bar (202B), or pole (202B) to be waving, shaking, swing, moving to make the any combination of (i) optic lens (203") or (ii) image-carrier (202") has texture or without texture or-and (iii) LED(s) (201") to be change position to make the said desired light effects for all kind of indoor or outdoor LED light or LED bulbs for light string or outdoor garden or seasonal project light device.

From FIG. 1CC It also same as the co-pending (#ZZZ-family) that the said moving parts (202B) is assembled or attached on the 1st optic-lens (202") or image carrier (202") at one end or side of two-sides-pole (202C) like the scale or weight-balance equipment so only need small magnetic-force between the magnetic-coil and magnetic-parts can easily to make the scale or weight-balance construction to make the optics-lens (203") or-and image-forming-unit(s) (202") to move like incorporate with motor (05") or movement (05) has same or equal or replace purpose. while the moving parts (202B) is moving and also move the optics-lens (203") or image-forming-unit (202") two-sides-pole (202C) sit on the two side frame (202D) will be also change position so make the said 1st optic-lens (203") or image-carrier (202") moving so make the image carrier (202") or-and 1st optics-lens (203") to emit the different light-beam to the top project-lens (203") or cover (203") and form the big viewing angle project image on the desired floor, ceiling or walls but not shown on the wall where has the outlet or surface has the bulb base.

From FIG. 3, FIG. 3A, FIG. 3B, FIG. 3C, FIG. 3D, FIG. 3E, FIG. 3F show the co-pending filing all kind of preferred LED bulb designs and shape. The inner may have all above discussed parts and accessories to make the desired moving optics-lens, moving image-carrier, different LED turn on and turn off time, magnetic reaction force device, or single project tube device, or multiple single project tube device, or project assembly inside these housing to get the wide viewing angle moving project-image show on the surface.

From FIG. 3, 3A, 3B, 3C, while the same construction of the 3 major basic-parts or major-components for project-assembly to fit into the one of preferred bulb shape housing with bulb-base can instantly become the LED Bulb has the moving project-image LED bub. Alternative or replacement or equal function to put the major 3 basic-parts or major components into the different housing of garden light, outdoor garden light set, or any outdoor or indoor AC Plug wired products, or AC powered products with different prongs, bulb-base or AC-plug-wire or outside transformer, or other conductive parts to get AC power source still is same of the current invention to use simples and minimum 3 major parts can create a low cost LED projection light with clear image or-and patterns those is moving or steady or fix and has big and large size image or-and patterns show feet or arms away from the LED light device.

From the FIGS. 3, 3A, both LED project light (30) (40) in bulb-shape housing or other shape-housing has the major 3 basic-parts of project-assembly (AA) LED (35)(42), and (BB) image-carrier (36') (45'), and (CC) reflective or diffusion or protective or refractive project-lens (38) (47). The difference at the project-assembly whether has the extra tube (43) or tubes (45) or tube-assembly (43 and 45) to make some image or-and pattern do not interfered by other LED(s) light source for non-colorful image/character/cartoon projection. For example like FIG. 3C which has the 2 types of the image-or-and-pattern projection those are moving images (63) (63') (63")(63"') and center (fix) colorful cartoon or character projection which has center is one individual image-or-and-pattern project-assembly which is surrounded by the 4 rotating lighted image-or-and-patterns (63) (63') (63")(63"'). Because the center (fix) is separated with the surrounding other project-assembly (63) (63') (63"O (63"), so need the tube (43) or tubes (45) or tube-assembly or housing-parts or walls to make the 2 different project-assemblies is isolated or separated each other to prevent light beam interfere to others. This is the major difference.

Also, the said tube (43) or tubes (45) or tube-assembly (43 & 45) also can be alternative or equal function or replace design to be a tray, a holder, a join-piece and each has wall surrounded to prevent light-beam to leakage out while assembled. This is other big features of current invention and co-pending filed case features which not existing at any US prior-arts. Other features is the co-inventor's refractive-lens is install on highest-housing opening or is install above top-of-inner-housing tube, so the refractive-lens spread light-beam will not blocked by higher tube or housing-parts and make the image is not spread-out wider.

From FIGS. 3B, 3C which show the LED project light has plurality of rotating or fixed-n-rotating project lighted image-or-and-patterns. From FIG. 3C has 4 rotating image-or-and-patterns which having mechanical construction similar with the FIG. 3. The FIG. 3C has center big size fixed lighted image-or-and-patterns projection assembly (fix) which is surrounded by the 4 rotating and moving lighted image-or-and-patterns project-assembly (63) (63') (63") (63') which has similar mechanical construction with the FIG. 3 or alternative or equal functions or replaced design or construction for LED indoor or outdoor light device, garden light, light string, seasonal project light has AC-plug wire, or outside transformer DC power source to supply power to inner circuit and controller.

For the FIGS. 3, 3A, 3B, 3C show one of plurality LED light applications, the housing design for this embodiment is bulb shape with bulb-base. It also can have other housing design such as garden light, light string or other application housing in geometric shape and construction so can instantly change to other LED light application but still keep the current and co-pending filing cases which (i) has unique installation for top refractive-lens, or-and (ii) tube/tubes/tube-assembly/holder-assembly/tray-assembly/housing parts for installation or isolate light-beam for interference, or-and (iii) desired combination for tray and holder and tube but each one has wall-surrounded so can joint-together without any light-beam leakage out. This is very important for current and co-pending invention while project character or cartoon or color from film or slide applications if light leakage out the shown big colorful and details cartoon or character or image will become dim or not easily recognition.

From FIG. 3B, 3C show some of plurality of all kind of LED light application for indoor or outdoor LED light or light string LED bulb outside shape and details inner construction. It is appreciated all non-show others or alternative way to get the moving project-image for night time use LED light all kind of applications should still fall within the current inventions claims and scope including outdoor project light, outdoor project light strips, indoor prong plug-in light. All these features also shown on the parent filed cases or same as Co-pending filing case (#ZZZ-3) U.S. application Ser. No. 14/503,647 now is U.S. Pat. No. 9,719,654 which apply (AA) the same 3 major components LEDs (01"'), image-carrier (02"), and Project-lens (03") to form the big viewing angle project-image, or (BB) has $1^{st}$ and $2^{nd}$ optics-lens and light-traveling back-and-forth within the more than one of reflective or-and refractive optics-lens with desired treatment or textures or marking.

From FIG. 3, 3A, 3B, 3C, 3D, 3E, 3F show the co-pending filing all kind of preferred LED project light applications here show the preferred project-bulb designs and shape. The inner may has the desired (i) moving-optics-lens, (ii) moving image-carrier, (iii) moving LED(s), or-and (iv) different LED turn on and turn off time, or-and (v) magnetic reaction force device, or-and (vi) single project tube device, or (vii) multiple piece of project tube-piece device, or (viii) project assembly inside these housing; to create or get the wide viewing angle moving project-image show on the building, garage door, fence, house, ceiling, walls or desired surface.

The drawings also show the one of embodiment from variety LED light application here is a LED bulb for indoor, outdoor bulb-socket or light string application which has its preferred construction or even incorporate with (AAA) the bendable or flexible bulb-base (78) as FIGS. 3D, 3E, 3F (which has long length of the bendable or flexible piece, or (BBB) similar with FIGS. 09-B1 to 09-B7.

LED bulb (325) has illumination or-and projection light function is injected with light string wire plastic has AC-plug wires to get AC power source.

(ii) LED bulb (326) in any geometric shape or market available all kind of LED bulb or LED recess light has only illumination or other desired functions including projection functions and base incorporated the string wires (326*a*) or conductive wire (326*a*) to assembly with the LED light base.

(iii) LED bulb (327) has a dome or sphere or ball shape (327) which has $1^{st}$ and $2^{nd}$ reflective or-and refractive optics-lens to make the people to make the project or illumination function with AC plug (327B) and conductive-wire (327*a*) or string wire (327*a*) or flexible bar (327*a*).

(iv) LED bulb (328) is one of LED bulb has built-in motion sensor with Fresnel lens (328') which can aim to desired position or location or orientation while adjustable flex-n-fixed position bar (328*a*) and the said flex-n-fixed position bar also can be string wire or conductive wire which connected with power input bulb screw-in bulb-socket or other conductive contact such as prong or AC plug of AC wire set. The LED bulb or LED light can be any shape or construction including the recess light application.

(v) LED bulb (329) is one of LED bulb has built-in body ventilation hole or heat-sink unit with desired construction to become traditional shape bulb or recess light application. Same as above the LED bulb (329) may has flex-n-fixed position bar or conductive wire or string wire to connect the power input contactors which can be prong, bulb-socket, AC-wire plug.

(vi) LED bulb (330) is one of LED bulb has built-in photo-sensor or motion sensor or camera system which has bulb body or housing add-on the said flex-n-fix position bar (330*a*) or conductive wire (330*a*) or string light wires (330*a*) with desired power input-end.

(vii) LED bulb (331) is one of the of multiple functions LED bulb not only can offer the project light function, but also has one or more other preferred functions including: outdoor floor light, or outdoor accent light, or outdoor garden light, or string-light, or accent light, or outdoor torch light, outdoor color changing light or string light, or motion sensor string light, or master control LED light string which only control one of plurality of LED bulbs can let rest of LED bulb change to same function of the said MASTER LED bulb; to offer more than one functions, or functions changing/selection functions, or brightness adjustable or hi-low or even medium light brightness from the said LED bulb (331)

From FIG. 3F also show the tilt or move housing, body, parts at horizon level so the LED bulb (90) offer more than one functions including (1) illumination from LED flat optic-lens (92) or-and side grill (91), and project or moving projection from the movable housing or body (95) offer the said illumination for near-by area and project lighted pattern, image, light beam to remote-away locations which has optic-lens with focus existing so can project remote location(s) not near-by illumination which has no focus-able light-beam existing.

From FIGS. 3D, 3E, 3F show the different bulb-socket which has flexible-n-fix position pole or bar or arms as FIG. 3D shown, or is conductive wire inside bendable plastic piece as FIG. 3E, or is extendable-and-retractable plastic piece as FIG. 3F shown so can aim the LED bulb fixed on the bulb-socket or LED bulb fixed on the string-light and can bend and fixed on the desired angle, position, orientation not only offer illumination as down-areas illumination but also can emit to any desired height, direction, angle to make plurality direction illumination or-and projection string light device and no more only down-light application. This is other major features while current invention for more than one functions LED bulbs has bend-n-fixed angle, direction, position arm, sleeve, plastic piece, metal piece so can offer more than one function LED bulb of string-light application become non-down illumination products.

From FIG. 4 and FIG. 4A, FIG. 4B disclosure the Co-Pending Filing (#ZZZ-2) U.S. application Ser. No. 14/451,822, and which is CIP of (# ZZZ-1) Application Ser. No. 14/323,318, and which is CIP of (# ZZZ-2013) Application Ser. No. 14/023,889 those drawing show the $1^{st}$ embodiment to use the said motor (405-4A) to drive the axis (4A) to rotating the top project-lens (not shown) which has multiple refraction or-and reflection lens to allow the inner LEDs (401-4) (401-4B) to passing though the multiple reflective or-and refractive lens to spread out the different turn on and turn off LED color light beam to wide viewing angle for moving project-image. The each of color of the said LEDs (401-4) and (401-4B) can be different color and turn on and turn off controlled by IC so can had all kind of light effect s including chasing, random, pair flash, fade-in and fade out, sequential, color changing, freeze function, auto changing function, 7 function in 1 or any other available function from market place.

The FIG. 4, FIG. 4A, FIG. 4B also has circuit (4C-4) (4C-4A) (4C-4B) and motor's gear set (405'-4) (405'-4A) (405"-4B) so can get desired rotating speed of axis (4A) to drive the top multiple reflective or-and refractive dome lens can rotate under predetermined speed to make people enjoy the moving and changeable color, function light effects from the said current invention for LED Night Light or LED Bub while the same construction fit into the plug-in Night light or fit into the said Bulb shape with the bulb base to get the Power source.

From FIG. 4 and FIG. 4A, FIG. 4B disclosure the co-pending filed case (#ZZZ-12) U.S. application Ser. No. 14/451,822 and (# ZZZ-1) Ser. No. 14/323,318 for the motor (405-4) and (405"-4A) with axis (4A) and has electric current input from AC (+) and AC (−) which connect with AC-plug-wires to get AC power source from outlets. The (# ZZZ-12) U.S. application Ser. No. 14/023,889 those drawing show the 1st embodiment to use the said motor (405-4A) to drive the axis (4A) to rotating the top project-lens or-and image-forming unit(s) which is single-piece or it has multiple or pluralities small segments/areas/section like FIG. 1A diamond-cut optics-lens (x6) and each has preferred refraction or-and reflection lens (x12) to allow the inner LEDs (401-4) (401-4B) to passing though the multiple or pluralities small segments/areas/section such as diamond-cut (x6) or prism-lens (x12) and each has preferred reflective or-and refractive lens to spread out the LED light beam. It also can have alternative arrangement that LED(s) (401-4) (401-4B) has the different turn on and turn off LED which has single or color light beam to wide viewing angle for moving project-image. The each color of the said LEDs (401-4) (401-4B) can be different color and turn on and turn off controlled by IC so can had all kind of light effects including chasing, random, pair flash, fade-in and fade out, sequential, color changing, freeze function, auto changing color function from 7 color or up to tens of color, or selected functions from one to N-number functions, or any other available function from market place.

From the FIG. 4 and FIG. 4A, FIG. 4B also has circuit (4C-4) (4C-4A) (4C-4B) and motor's gear set (405"-4) (405"-4A) (405"-4B) so can get desired rotating speed of axis (4A) to drive the top multiple or pluralities small segments/areas/section optics-lens like FIG. 1A, 1B, 1C diamond-cut (x6) prism-lens (x12) and each has preferred reflective or-and refractive dome lens (x6) can rotating under predetermined speed to make people enjoy the moving and changeable color, function light effects from the said current invention for LED night time use light or LED Bub or AC plug wired outdoor light or garden light or light string or outdoor project light while the same construction fit into or built-in (i) the plug-in Night time use light or (ii) the said Bulb shape with the bulb base or (iii) AC plug wired outdoor garden or (iv) light string has more than one functions and not only down areas illumination, or (v) outdoor project light or (vi) outdoor seasonal light which connect to AC Power source.

From FIG. 5A disclosure one of plurality LED light device including outdoor garden light or string light, the current embodiment is one of LED bulb or LED garden light both has bulb-base or AC Plug-wire to get AC power source these has the same construction with the FIGS. 2, 3, 3A, 3D, 3F which has the Moving or Rotating optic-lens-assembly (503D) which has the 6 of the single optic-lens (503-1) which can project the shaped or tiny-image light beam through the refractive lens (503-1) to become big project-image shown on the desire surface. The current invention has the 6 single optical-lens arrange within a frame or disc or carrier (5F) for 360 degree so each single optic-lens (503-1) almost cover the 60 degree of the said frame (5F). So, the wide viewing angle project-image will move se around 60 degree for circle range while the top project-lens-assembly each single project lens takes 60 degree, then the big project image traveling will be around 60 degree.

It is appreciated any (i) different spacing for plurality of small project-lens and (ii) this embodiment is not limited for LED bulb application only it also cover the all LED outdoor light, or LED garden light, or LED seasonal light, or LED projection light, or LED patio light string, LED seasonal string light with AC-plug wire with built-in or outside switch or sensor or control the said color, brightness, selected function, change function, selected hi/low brightness, dimmable switch for desired light function, light performance; still fall within the current invention scope and claim covered.

The said LEDs (501-1) has narrow viewing angle so may have optional optic-lens added like FIG. 5B (502-2) to let the narrow light beam become wider viewing angle light beams or add the distance from the LED top to the image-carries but it will be loose some light brightness. While the LEDs light beam emits to top the said image carrier (502-1) through the image carrier's (502-1) openings, printed windows, stencils, cutouts, films, slide, display-units or changeable image or display, the said lighted shaped or tiny-image light beam will emit to top single optical-lens (503-1) fixed on the said frame (5F) of the said projection-lens-assembly (503D). The wider viewing angle the said shaped or tiny-image light beam goes through the said each single optics-lens (503-1) and form the image because all the optic-lens (503-1) is rotating one by one so the each of single optic-lens image will look like a continue one image to moving from circle one side to other side for certain degree depend on the each of single optic-lens (503-1) occupy how many angle of the said frame (5F).

The FIG. 5A, the image carrier (502-1) has 4 shaped opening, holes, cutout, printed windows (window is not punch through as opening), film, slide, display-unit, changeable display windows so can project 4 different images if had relatively LED for the said 4 different tiny-images that is openings, holes, cutout, printed windows, film, slide, display-unit, changeable display windows to create the 4 big project-image and rotating on all same direction or desired directions.

From FIG. 5A the LED (501-1), Image carrier (502-1), project lens assembly (503-1) and single optics-lens (503-1) and motor (505A) and gear set (505"-1) all arranged along the axis (5A) with desire frame, support, bar, tube, holder (5F) or fix on the housing parts (not shown) so whenever the outside housing changed to different construction such as garden light, string light, string light bulb, floor light, touch light for outdoor application, the current invention can be change from preferred embodiment for LED night light or LED bulb and instant to change become different construction such as garden light, string light, string light bulb, floor light, touch light for outdoor application and each had its prong or Bulb base or AC-plug-wire or battery to get the AC power for outdoor applications.

From the FIG. 5B same as the all co-inventor and co-pending LED project light has the same LEDs (501-2) and image-carrier (502-2) and Project-lens assembly (503-2) with single optic-lens (503D) and only the said project-lens-assembly is rotting along the axis (5A) with tube or tube assembly to install the said other optional optic-lens to wider the narrow LEDs light beam and use the tube or tube-assembly to prevent from the light beam leakage to interfere other light performance so can concentrate all LED wide light beam to cover as many as single optic-lens. Or/The Tube or tube-assembly it is an optic-lens to make the narrow LED light become wider and also can prevent from the light leakage through the wall of the said Optic-like tube or tube-assembly. This depend on the market requirement so this FIG. 5B is for just concept for optic-like tube which can be in any shape such as wider top and narrow end types of optic-like tube or tube-assembly (Not shown).

From FIG. 5C show the alternative way the image-carrier is a film or slide which fit into the optic-like tube or tube-assembly which may straight or wider-top-narrow-base optical-tube which has reflective material coated outside so no light can leakage to outside and LEDs may also into the one end of the optic-like tube or tube-assembly so even the film or slide is install within the optic-like tube inside by groove, holder, ring. So, the wider shaped or tiny-image light beam emit to top rotating single optic-lens (503-3) and create moving rotating certain degree multiple big projection image such as STARWAR characters, Frozen character or any Disney Characters or cartoon, time, logo, art work etc.

From FIG. 5A the LED (501-1), Image carrier (502-1), project lens assembly (503-D) and single optics-lens (503-1) and motor (505A) and gear set (505"A) all fix or arrange or assembled near or along the axis (5A) with desire frame (5F) or install or fix on the housing parts (not shown) so whenever the outside housing changed but use same 3 basic-part or 3 major components with the current invention. The products can instant to become new products for example the products can be (i) LED night light or (ii) LED bulb or (iii) any AC plug wired or AC-to-DC outside transformer or (iv) AC-to-DC built-in circuit; of AC power outdoor light, garden light, or seasonal light, or-and light-string without housing or with housing which has project functions still fall within the current invention, and Each products as above listed has 3 major components for simple construction and low assembled cost but can get clear and enlarge clear image or lighted patterns and those had its prong or Bulb base or AC plug wire or AC-to-DC transformer or AC-to-DC circuit to get the AC power for outdoor lighting or garden light or seasonal light has project function still fall within the current invention scope and claims.

From the FIG. 5B same as the all co-inventor and co-pending LED project light has the same LEDs (501-2) and image-carrier (502-2) and Project-lens assembly (503-D) with single optic-lens (503-2) and only the said project-lens-assembly (503-D) is rotting along the axis (5A). The said LED night time use light or LED bulb or LED outdoor/seasonal/project light can has optional different length/diameter/size/shape tube or tube-assembly or housing-parts or other parts to prevent from desired image-or-and-patterns been interfered by other light-beam, or-and make the individual desired image by its own project-assembly with built-in LED(s) and image-carrier and refractive-lens, or-and install the said other optional optic-lens to wider the narrow LEDs light beam and also use the tube or tube-assembly or housing or parts, or-and prevent from the light beam leakage so can concentrate all LED wide light beam to deliver or emit or cover as many as single optic-lens.

The tube or tube-assembly or housing or parts has optional or extra project-assembly which has 3 basic-parts inside, or $2^{nd}$ optics-lens to make the narrow LED light beam to become DL wider before emit into image-forming-unit, and tube or tube-assembly also can prevent from the light leakage out. This depend on the market requirements so this FIG. 5B is for just concept for optic like tube or tube-assembly which can be in any shape such as wider top and narrow end type of optic-like tube or tube-assembly (Not shown).

From FIG. 5C show the alternative way the image-carrier (502-3) is a film or slide which fit into the optic-like tube (5T) or tube-assembly which may straight or wider-top-narrow-base optical-tube (5T) which has light-block-out to made of or reflective material coated outside so no light-beam can leakage to outside and LEDs (501-3) may also into the one end of the optic-like tube (short of 5T) or tube-assembly and the film or slide is install within the optic-like tube (longer of 5T) inside tube's the said by groove, holder, ring. So the lighted shaped or tiny-image light beam or pattern(s) can get maximum brightness to emit to top rotating or fixed single optic-lens (503-3) and create (i) fixed, or (ii) moving rotating certain degree multiple big projection image such as STARWAR characters, Frozen character or any Disney Characters or cartoon, time, logo, art work . . . etc.

From FIG. 6 show the 3 main components LEDs (601-LED), image carrier (02-ImCa) project-lens-assembly (603-PL) to make the wider viewing angle big moving project image. The said LEDs (601-LED) has its relatively top image carrier (602-ImCa) so can has the shaped or tiny-image light beams to emit to the project-lens-assembly (603-PL) each single project-lens to get the continuously moving clear and big project-image to travel certain degree of the circle with wide viewing angle to viewer.

The LEDs (601-LED) has narrow light beam as right hand side of FIG. 6 for narrow light beam (N1) through the other optic-lens (OP-1) or optics-like tube (OP-1) can become wider (W2) and passing through the image carrier (02-ImCa) with some distance to get much wider (W3) shaped or tiny-image light beam to emit to project-lens-assembly (03-PL) to form the continuously moving big project-image (604-MBPI). The more LEDs (601A, 601B, 601C, 601D) and its image-carrier (604A) can get more moving big project image. The moving big project image (604-MBPI) the moving direction for clock-wise or anti-clock wise will be depend on the motor and its gear-set direction. The moving big projection image (604-MBPI) moving angle will depend on the number of single optics-lens (604E) number within the 360 degree of holder or frame. More single optics-lens (604E) will has less traveling angle of the said moving big project image (604-MBPI). For the FIG. 6, the 6 single optic-lens (604E) within the 360 degree frame or holder, the moving big project-image (04-MBPI) will travel around 360/6=60 degree. So more single optic-lens (o4E) inside of the frame (F) will get less travel angle. Also, the less openings (604B), cutouts (604C), printed windows (604D), film (604B), slides (604E) will get less type/design/shape/image of the moving big project-image (04-MBPI). Also, if only had one top single optic-lens with one printed-window, the one continues moving big project image (604-MBPI) will move very slow because the axis rotate 360 degrees only had one single optic-lens can project image for around 180 degrees. So the moving big project image (604-MBPI)

The LEDs (601-LED) has narrow emit-out angle light-beam as right hand side of FIG. 6 for narrow light beam (N1) through the optional added other optic-lens (OP-1) or optics-like tube (OP-1) can become all parallel-directional wider light-beam (W2) and passing through the image-carrier (602-ImCa) its shape-openings (604A) with some distance to get the more wider shaped or tiny-image light-beam (W3) to emit to project-lens-assembly (603-PL) each of the refractive-lens (604F) to form the continuously moving big project-image (604-MBPI) to project to outdoor housing, building, fence, patio, wall or indoor ceiling, wall, floor. The more LEDs (601A, 601B, 601C, 6 01D) or dice-LED(s) (601A") and its image-carrier (604A to 604E) can get more moving big project image (604=MBPI) but it will reduce the travel arc or degree shown on the desired area/surface/locations. The moving big project image (604-MBPI) the moving direction for clock-wise or anti-clock wise will be depend on the motor and its gear-set direction. The moving big projection image (604-MBPI) moving angle will depend on the number of single optics-lens (04E) number within the 360 degree of holder or frame. More single optics-lens (604E) will has less traveling arc or angle of the said moving big project image (604-MBPI). For the FIG. 6, the 6 single optic-lens (604E) within the 360 degree frame or holder, the moving big project-image (604-MBPI) will travel around 360/6=60 degree. Whenever has more single optic-lens (604E) inside of the frame (6F) will get less travel arc or angle. Also, the less openings (604B), cutouts (604C), printed windows (604D), film (04B), slides (604E) will get less type/design/shape/image of the moving big project-image (604-MBPI). Also, If only had one top single optic-lens with one printed-window, the one continue moving big project image (604-MBPI) will move very slow because the axis rotate 360 degree only had one single optic-lens can project image for around 180 degree. So the moving big project image (604-MBPI).

Figure 31:
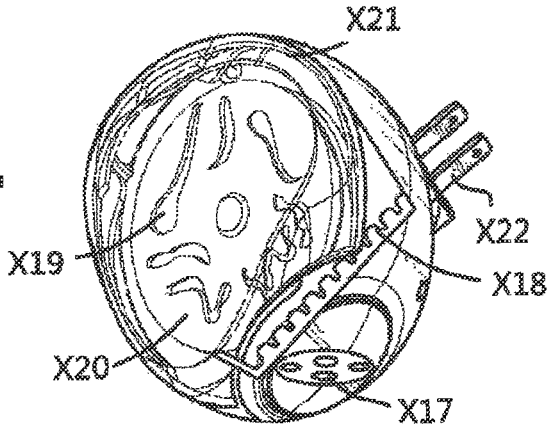
Figure 33:
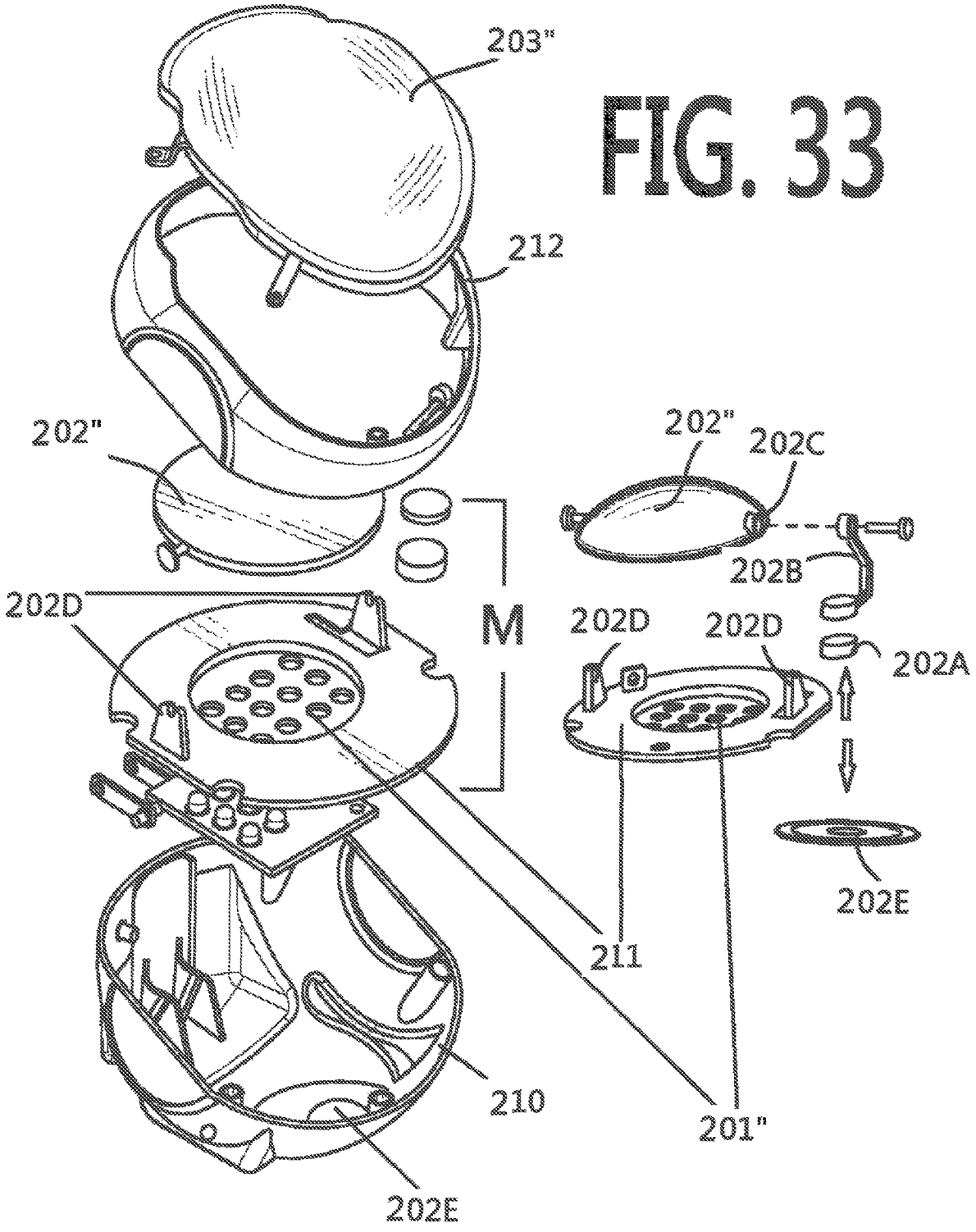
Figure 34:
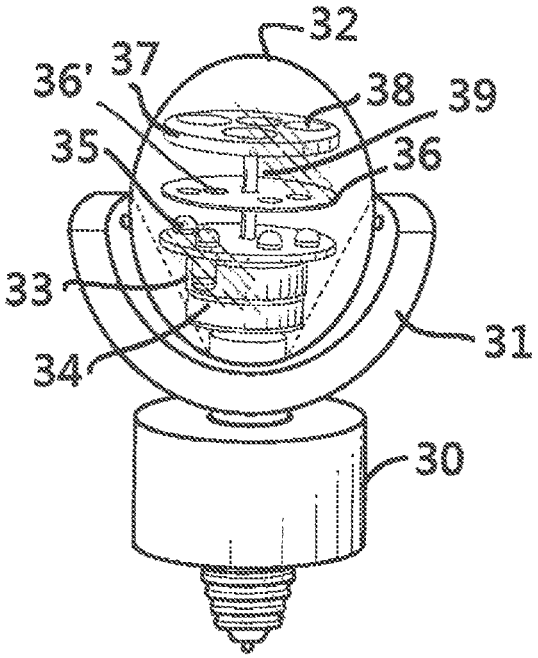
Figure 35:
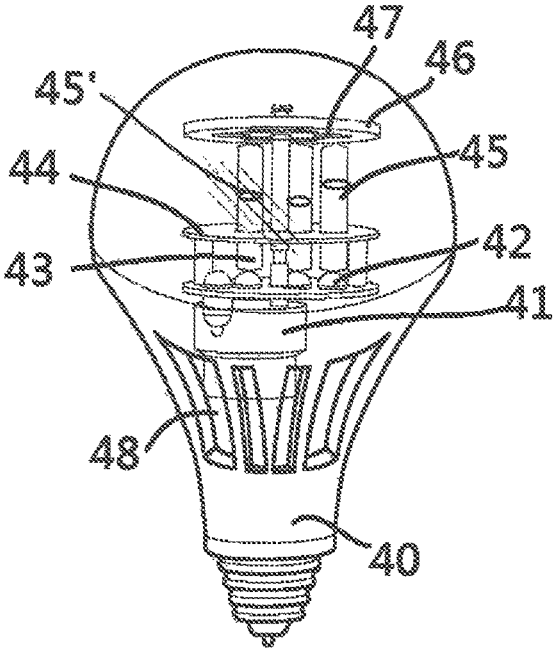
Figure 36:
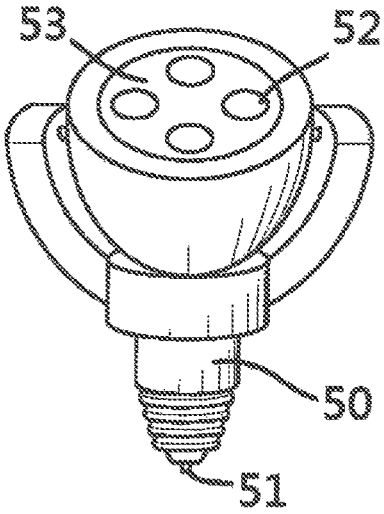
Figure 37:
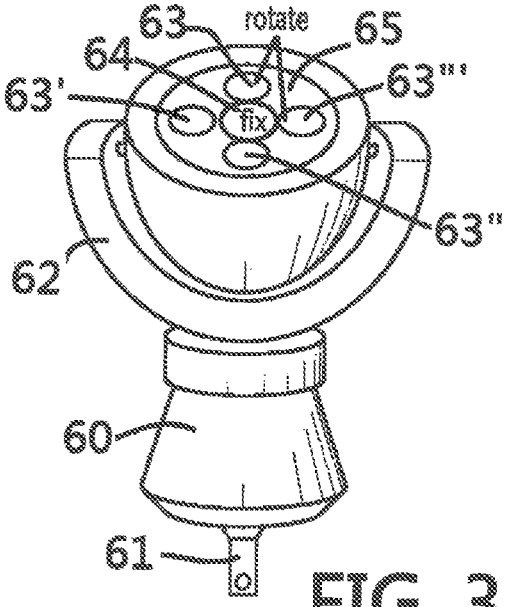
Figures 38, 39, 40:
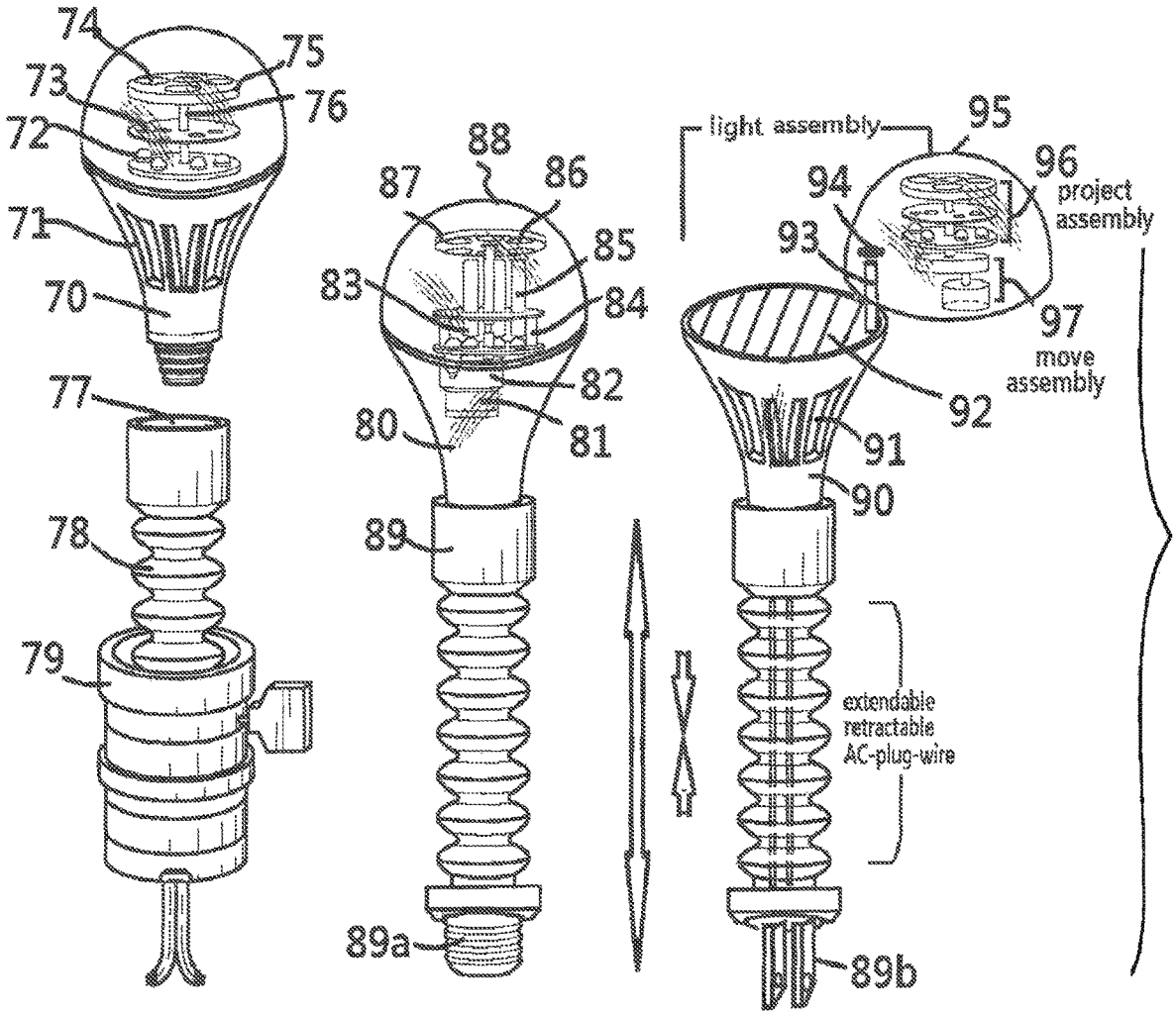
Figure 41:
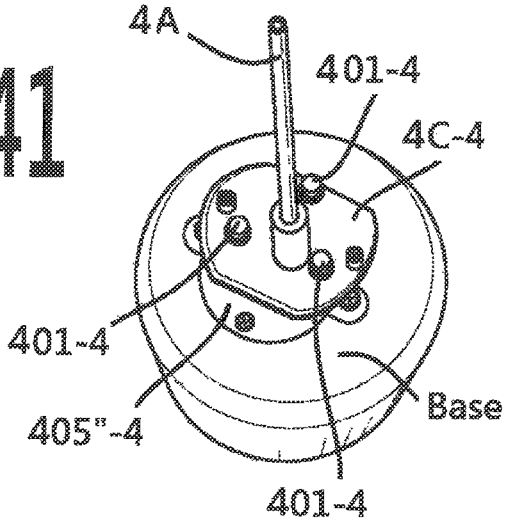
Figure 42:
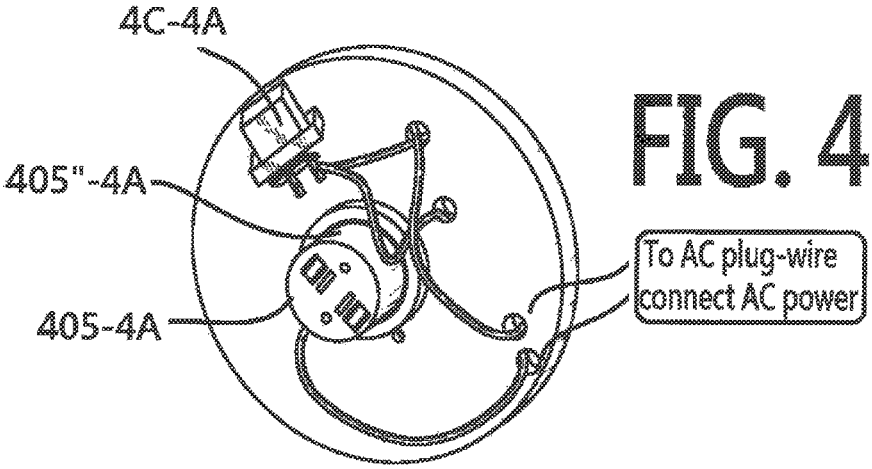
Figure 43:
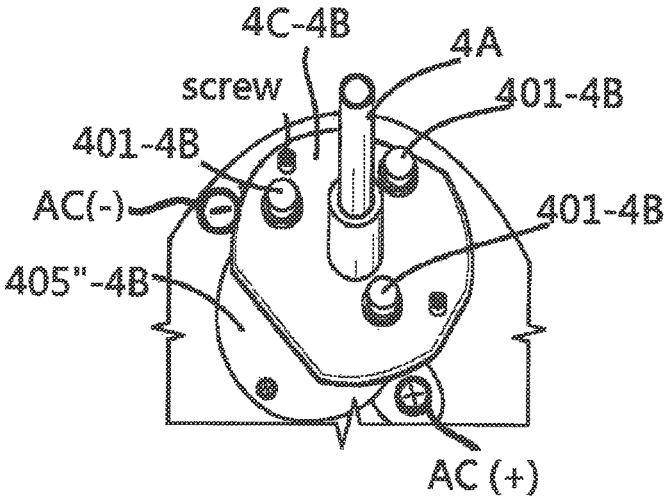
Figure 44:
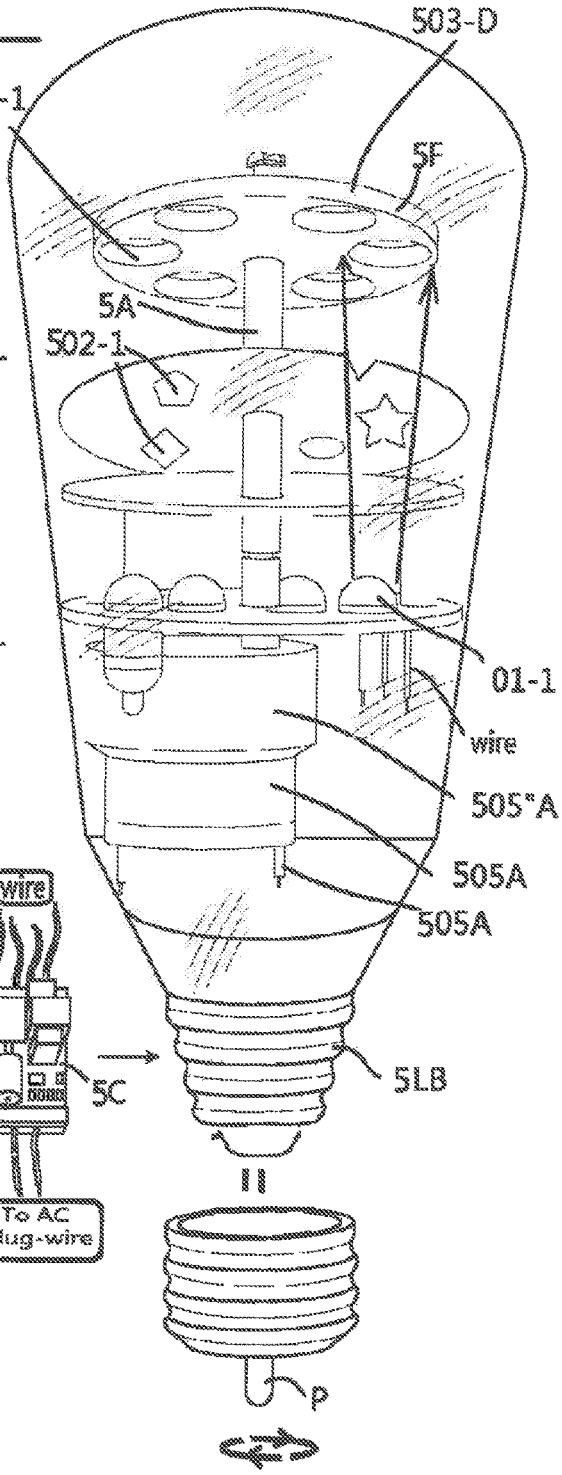
Figure 45:
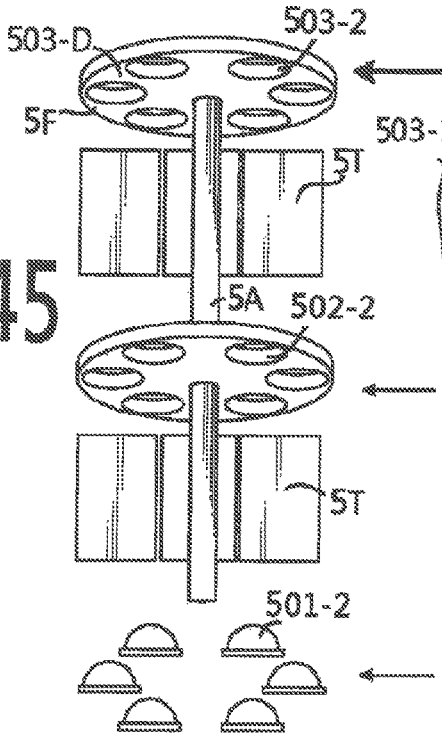
Figure 46:
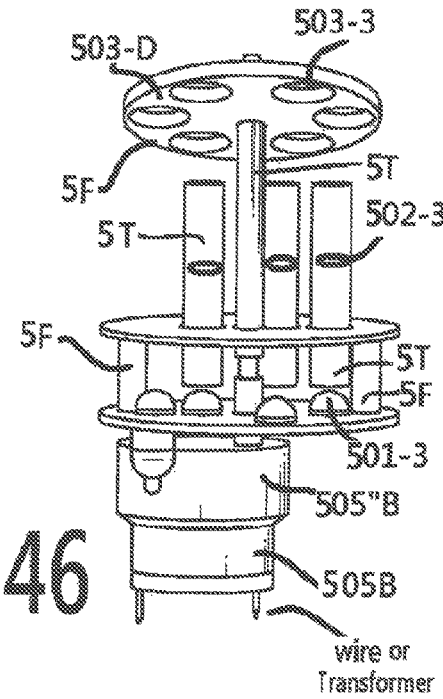
Figure 47:
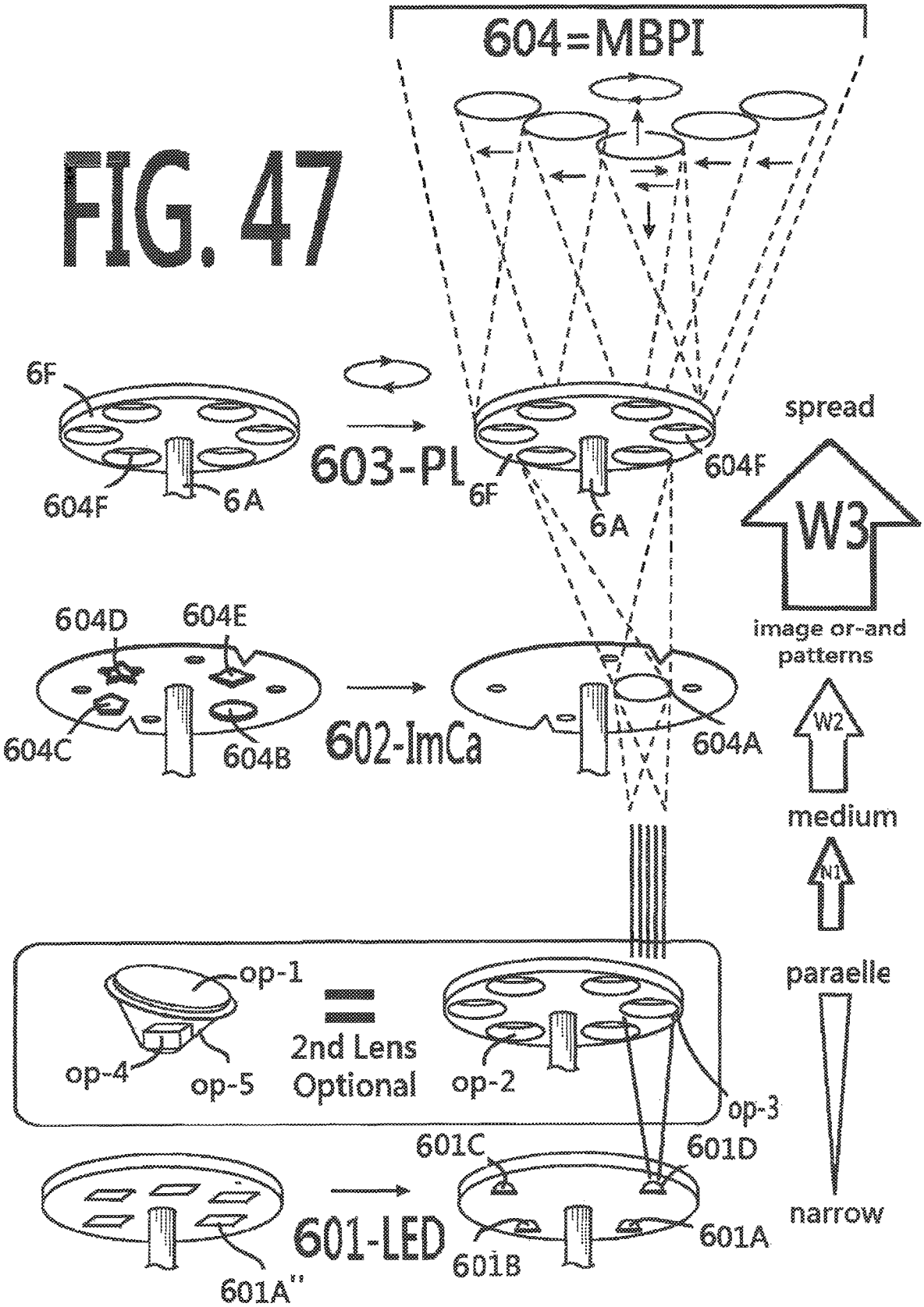

From FIG. 6-show the said LEDs (601A) (601B) (601C) (601D) has narrow light emit-out viewing angle so may has optional optic-lens (op-1) of FIG. 6 added or like FIG. 31B (502-2) to let the narrow emit-out angle light-beam become wider and all parallel direction light-beams or add the distance from the LED (601A to D) top to the image-carries (604A) but increase the distance for LED (601A to D) and image-forming unit (604A) will lose some light brightness. While the LEDs light-beam emit to top the said image-carrier (604A) through the image carrier's (604A) openings, printed windows, texture lens, variable thickness lens, printed piece, stencils, cutouts, films, slide, display-units or changeable image or display, the said lighted shaped or tiny-image light beam will emit to top single optical-lens (604F) fixed on the said frame (6F) of the said projection-lens-assembly. The wider viewing angle the said shaped or tiny-image light beam go through the said each single optics-lens (604F) and form the image because all the optic-lens (604F) is rotating one by one so the each single optic-lens image will look like a continue moving same image to moving from (i) $1^{st}$ arc position to $2^{nd}$ arc position, or (ii) from circle one side to other side for certain degree depend on the each single optic-lens (604F) occupy how many angle of the said frame (6F). The FIG. 32 show is the major project-assembly apply to all kind of LED projection light of current invention which has movable or rotatable one or more than one project refractive-lens or-and image-carrier or LED(s) fit into tray, holder, disc to make desired combination to make pre-determined light function and only need change any one of 3 basic-parts little details can create hundreds or thousands variation or products for outdoor lighting including garden light, patio light, light string for seasonal or everyday as the co-pending filed case (#11-09) (#M) (#II-2) as above disclosure filed date, public-date and issued date v.s. the current invention filed date. Same as the FIG. 5A construction.

The invention claimed is:

1. An LED light having projection functions for outdoor application, comprising:

at least one LED; and at least one optics element for projecting a lighted pattern or image on an outdoor surface that is spaced from the LED, wherein the at least one optics element is selected from at least one of the following:

(a) fixed, movable, or rotatable first and second optics lenses having textures, treatments, or varying thicknesses that cause the pattern or image to be created as light beams pass through at least one of the first and second optics lenses;

(b) at least one fixed, movable, or rotatable first optical element having at least one opening, cutout, window, stencil, or printing to create the pattern or image, and a lens that enlarges or modifies the pattern or image created by the first optical element;

(c) a fixed, movable, or rotatable film, slide, screen, or changeable digital data display that forms the pattern or image, and a lens that enlarges or modifies the pattern or image, and wherein the LED light further includes at least one component for causing movement of the projected lighted pattern or image, the at least one component being selected from: (i) at least one movement device for moving the at least one LED or optics element, or a top or front cover of the LED light, and (ii) a controller for controlling on and off time of more than one of said at least one LED to generate motion effects.

2. The LED light as claimed in claim 1, wherein the LED or laser light is an outdoor garden light, floor light, torch light, accent light, or light string.

3. The LED light as claimed in claim 1, further comprising a focus device for adjusting a focus of the projected lighted pattern or image.

4. The LED light as claimed in claim 1, further including a second light source, wherein the LED light is adapted for illuminating areas that are adjacent the LED as well as for illuminating areas that are away from the LED light.

5. The LED light as claimed in claim 1, wherein the at least one component is a movement device adapted to cause the at least one optics element or the at least one LED or laser source to move, rotate, spin, or change position to move the projected lighted pattern or image.

6. The LED light as claimed in claim 1, wherein the at least one LED or laser light includes a bulb-shaped housing.

7. The LED light as claimed in claim 1, wherein the LED or laser light is configured as a bulb for an outdoor light string.

8. The LED light as claimed in claim 1, wherein the LED or laser light is connected to an AC power source by an AC plug or AC power cord.

9. The LED light as claimed in claim 1, further comprising a rotatable disc or movable holder for a plurality of lenses, slides, films, printed pieces, or image forming pieces, wherein rotation of the disc or movement of the holder changes the pattern or image.

10. The LED light as claimed in claim 1, wherein the movement device moves the rotatable disc or movable holder to cause said movement of the projected lighted image or pattern.

11. The LED light as claimed in claim 1, wherein the LED or laser light is one of an outdoor accent light, torch, and floor light that also has lighted pattern or image projection functions, wherein the LED light is supported by a post or stand installed in the ground.

12. The LED light as claimed in claim 1, wherein the LED or laser light is included in a light string and has a controller having at least one of a motion sensor, photo sensor, wireless transceiver, remote control, function changing switch, color selector, and brightness selector.

13. The LED light as claimed in claim 1, wherein the LED or laser light is powered by an AC plug-wire or outside transformer connection to an AC power source, or by solar power.

14. An LED light having moving image or pattern projection functions for outdoor application, comprising:

at least one LED;

at least one fixed, movable, rotatable, or replaceable optics element for projecting a lighted pattern or image on an outdoor surface that is spaced from the LED light; and at least one motor and gear set for moving or rotating the at least one optics element, an assembly including the at least one optics element, or a top cover of the LED light, to move or rotate the projected image or lighted pattern wherein the at least one fixed, movable, rotatable, or replaceable optics element is selected from at least one of the following:

(a) at least one optics lenses having textures, treatments, or varying thicknesses that cause the pattern or image to be created as light beams pass through the first and second optics lenses;

(b) at least one first optics element having at least one opening, cutout, window, stencil, or printing to create the pattern or image, and a lens that enlarges or modifies the pattern or image created by the first optics element;

(c) a film, slide, screen, or changeable digital data display that forms the pattern or image, and a lens that enlarges the pattern or image.

15. The LED light as claimed in claim 14, wherein the LED or laser light further includes at least one component for causing movement of the projected lighted pattern or image, the at least one component being selected from: (i) a movement device for moving at least one element of the LED light, and (ii) a controller for controlling on and off time of more than one of said LED or laser source to generate motion effects.

16. The LED light as claimed in claim 15, further comprising a rotatable disc or movable holder for a plurality of lenses, slides, films, printed pieces, or image forming pieces, wherein rotation of the disc or movement of the holder changes the pattern or image, wherein the movement device moves the rotatable disc or movable holder to cause said movement of the projected lighted image or pattern.

17. A laser projection light for outdoor applications, comprising:

at least one laser source; and optics elements for projecting a lighted pattern or image on an outdoor surface that is spaced from the laser light, the optics elements including at least one grating piece that splits laser light beams into multiple beams to form the pattern or image, and at least one of: (i) a fixed, movable, rotatable, or detachable top or front protective cover having space to accommodate the at least one grating piece, (ii) a fixed, movable, rotatable, or detachable top ring cover having space to fit the at least one grating piece, and (iii) a fixed, movable, rotatable, or detachable projection lens, wherein the laser light further includes at least one component for causing movement of the projected lighted pattern or image, the at least one component being selected from: (i) a movement device for moving at least one of the laser light source, the grating piece, the protective cover, the ring cover, and the projection lens, and (ii) a controller for controlling on and off time of more than one of said laser source to generate motion effects.

* * * * *